US006934484B2

(12) United States Patent
Suzuki et al.

(10) Patent No.: US 6,934,484 B2
(45) Date of Patent: Aug. 23, 2005

(54) IMAGE-FORMING APPARATUS AND IMAGE-FORMING METHOD

(75) Inventors: Koji Suzuki, Kanagawa (JP); Mitsuo Aoki, Shizuoka (JP); Hiroto Higuchi, Shizuoka (JP); Shinya Nakayama, Shizuoka (JP); Maiko Kondo, Shizuoka (JP); Bing Shu, Shizuoka (JP); Yasushi Koichi, Kanagawa (JP); Tadashi Kasai, Tokyo (JP); Yutaka Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/631,727

(22) Filed: Aug. 1, 2003

(65) Prior Publication Data

US 2004/0076443 A1 Apr. 22, 2004

(30) Foreign Application Priority Data

| | | |
|---|---|---|
| Aug. 1, 2002 | (JP) | 2002-224624 |
| Aug. 1, 2002 | (JP) | 2002-224627 |
| Sep. 13, 2002 | (JP) | 2002-268775 |
| Sep. 24, 2002 | (JP) | 2002-276434 |

(51) Int. Cl.[7] ..... G03G 15/20
(52) U.S. Cl. ..... 399/69
(58) Field of Search ..... 399/69, 328, 307, 399/313, 302, 312, 67; 219/216

(56) References Cited

U.S. PATENT DOCUMENTS

| | | | | |
|---|---|---|---|---|
| 4,330,195 A | * | 5/1982 | Lavallee | 399/4 |
| 5,085,962 A | * | 2/1992 | Aslam et al. | 430/99 |
| 5,981,121 A | * | 11/1999 | Ide | 430/45 |
| 6,060,201 A | | 5/2000 | Kinoshita et al. | |
| 6,088,565 A | * | 7/2000 | Jia et al. | 399/302 |
| 6,120,960 A | | 9/2000 | Aoki et al. | |
| 6,219,498 B1 | * | 4/2001 | Katoh et al. | 399/45 |
| 6,228,550 B1 | | 5/2001 | Matsuda et al. | |
| 6,335,137 B1 | | 1/2002 | Suzuki et al. | |
| 6,403,275 B1 | | 6/2002 | Kuramoto et al. | |
| 6,468,706 B2 | | 10/2002 | Matsuda et al. | |
| 6,534,232 B1 | | 3/2003 | Matsuda et al. | |
| 6,544,704 B1 | | 4/2003 | Matsuda et al. | |
| 6,593,048 B2 | | 7/2003 | Sasaki et al. | |
| 2003/0129511 A1 | * | 7/2003 | Kabata et al. | 430/56 |

FOREIGN PATENT DOCUMENTS

| | | |
|---|---|---|
| JP | 55-87156 | 7/1980 |
| JP | 3-186879 | 8/1991 |
| JP | 5-107796 | 4/1993 |
| JP | 5-216354 | 8/1993 |
| JP | 6-35341 | 2/1994 |
| JP | 6-175512 | 6/1994 |
| JP | 6-230599 | 8/1994 |
| JP | 7-5776 | 1/1995 |

* cited by examiner

*Primary Examiner*—Quana Grainger
(74) *Attorney, Agent, or Firm*—Oblon, Spivak, McClelland, Maier & Neustadt, P.C.

(57) ABSTRACT

In a copier which is an image-forming apparatus comprising a photoconductor 1, a developing apparatus 4, transfer apparatus 5 which transfers a toner image formed on the photoconductor 1 to a transfer material by heat and pressure using a transfer roller 52, and a fixing apparatus which fixes the toner image transferred to the transfer material, on the transfer material, a heater 56, temperature detection apparatus 57 and temperature control apparatus are provided which controls the temperature to within a range of from the glass transition temperature (Tg) to the softening temperature (Tm) of the toner, and lower than the fixing temperature of the fixing apparatus 7.

30 Claims, 2 Drawing Sheets

IMAGE-FORMING APPARATUS AND IMAGE-FORMING METHOD

BACKGROUND OF THE INVENTION

1. Field of the Invention

The present invention relates to an image-forming apparatus such as a copier, a facsimile and a printer, in particular an image-forming apparatus comprising a latent image carrier which forms a latent image on its surface, a developing means to render this latent image into a visible image as a toner image by adhesion of toner, a transfer means which transfers the toner image formed on this latent image carrier to a transfer material without using an electrostatic transfer method, and a fixing means which fixes the transferred toner image on the transfer material by heat and pressure. The present invention also relates in particular to an image-forming method using this image-forming apparatus.

2. Description of the Related Art

In the prior art, in this kind of image-forming apparatus, an electrophotographic image-forming method is used wherein an image is formed in a large number of steps, such as a latent image-forming step, a developing step, a transfer step and a fixing step. For example, in the case of a copier, a document is converted into electrical signals by a scanner or an optical system. In the case of a printer, electrical signals are directly input. An electrostatic latent image is formed on a charged photoconductor on which an optical image is applied by a patterned irradiation of a laser beam or the like, the patterned irradiation being made by the electric signals. A charged colored fine powder such as a toner is made to adhere to the latent image in a developing step. This is then electrostatically transferred to a transfer paper in a transfer step. Recently, in the color-printing field, various methods are being used to transfer a three- or four-colored toner image to an intermediate transfer object. The toner is then melted and fixed on the transfer paper to form the image.

In each of the aforesaid steps, deterioration of the image (including the latent image) occurs. It is particularly well-known that deterioration of the image is especially large during developing, transfer and fixing.

In the developing step, as toner adheres electrostatically to the photoconductor latent image due to the electric field surrounding the toner on the photoconductor, developing takes place over a larger area than the latent image or becomes blurred due to scratching of the carrier, and image deterioration of the electrostatic latent image occurs. In recent years, this has been improved by the fineness and sphericity of toner and the fineness of the carrier, but it still does not give sufficient image quality.

In the transfer step, a transfer material transported in synchronism with the photoconductor to which the developed toner adheres is brought into contact, and is electrostatically transferred from the photoconductor to a transfer paper due to the electric field. However, dust and blurring occur electrostatically during intimate contact with the transfer paper before and after this transfer step, and image deterioration increases.

Also in the fixing step, deterioration may occur due to the spread of the toner image from melting of toner in the step wherein toner is fused with the transfer paper. Further, when there is scatter in the amount of toner deposit on the transfer paper, scatter in the dot diameter or line width may increase, and deterioration may occur.

Of the aforesaid image deteriorations, the image deterioration in the transfer step is particularly large. In this regard, various techniques of performing the transfer step and fixing step simultaneously have been disclosed.

For example, in Japanese Patent Application Laid-Open (JP-A) No. 55-87156, a method of performing transfer and fixing on the transfer paper simultaneously using an amorphous silicone photoconductor and a heating fixing roller is disclosed. JP-A No. 06-175512 discloses a method of performing transfer and fixing simultaneously by thermal energy using a polymerization toner.

In these methods, as it is possible to transfer the toner image without a transfer electric field, a toner image of low resistance toner can also be transferred well, while avoiding image deterioration due to transfer dust.

To obviate the adverse effect of heat on the system, a method which does not heat but performs simultaneous transfer and fixing only by pressure has been proposed. For example, in JP-A No. 03-186879, a method of fixing at a pressure of 1470-2450 N/cm$^2$ is disclosed. In JP-A No. 05-216354 or JP-A No. 06-35341, a method of carrying out simultaneous transfer and fixing of toner image on a photoconductor by a transfer fixing apparatus facing the photoconductor, using an amorphous silicone photoconductor and capsule toner, is disclosed.

In JP-A No. 07-5776, a method of applying a transfer bias to a pressure roller using an amorphous silicone photoconductor, and using capsule toner as toner, is disclosed.

Many techniques for using capsule toner are disclosed for example in JP-A No. 05-107796 and JP-A No. 06-230599.

However, in the simultaneous thermal transfer and fixing method which performs transfer and fixing simultaneously by heat disclosed in JP-A No. 55-87156, since a heating body touches the photoconductor, the circumference of the photoconductor reaches a temperature higher than the melting point of the toner. For this reason, a large stress acts on the toner at the photoconductor, developing apparatus and cleaning apparatus, and presents a major problem in practical applications. Even if a cooling device is provided, damage to the photoconductor, the toner on the photoconductor and the developing apparatus, is unavoidable.

In the simultaneous pressure transfer and fixing method as disclosed in JP-A No. 03-186879 in which transfer and fixing are simultaneously performed by pressure alone, it is necessary to apply a large pressure from the viewpoint of transfer fixability. For example, in JP-A No. 05-216354, it is stated that the transfer fixing pressure is preferably 980 N/cm$^2$ or more. This requires a larger and heavier apparatus due to mechanisms and transfer paper transportation, and leads to fixing creases in the transfer paper and image broadening. Due to these problems, simultaneous transfer and fixing only by pressure are not in practical use.

Moreover, in the inventions disclosed in JP-A No. 05-216354 and JP-A No. 07-5776, the toner image can be transferred to the recording medium by pressurizing and crushing a capsule toner in a transfer position without a transfer electric field. However, it is difficult to reconcile good developing and fixing properties for the capsule toner, and there is the drawback of high cost.

SUMMARY OF THE INVENTION

It is therefore an object of the present invention, which was conceived in view of the above problems, to provide an image-forming apparatus and image-forming method which avoid toner deterioration and damage to apparatus due to heat, avoid the problems of the pressure-only method such as enlargement of apparatus, creases and image broadening, and suppress image deterioration due to transfer dust without using a capsule toner.

In order to attain this purpose, the image-forming apparatus of the present invention comprises a latent image carrier which forms a latent image on its surface, a developing means to render this latent image into a visible image as a toner image by adhesion of toner, a transfer means to transfer this toner image formed on this latent image carrier to a transfer material by heat and pressure using a heating roller without using an electrostatic image transfer method, and a fixing means by which the toner image transferred to this transfer material is fixed on this transfer material. An essential feature is the provision of a temperature control means which controls the heating temperature by the transfer means within a range of from the glass transition temperature (Tg) to the softening temperature (Tm) of the toner being used, and lower than the fixing temperature of the fixing means.

In this image-forming apparatus, the toner is heated by the heating roller of the fixing means to within a range from the glass transition temperature of the toner to the softening temperature. This causes a plastic deformation of the toner so that it adheres to the surface irregularities of the transfer material in an anchor effect. Then, the toner which adheres to the transfer material is thoroughly fixed by the aforesaid fixing means.

As the toner image can be transferred without using a capsule toner, image deterioration due to transfer dust can be avoided without using a capsule toner. Also, as the fixing means is provided separately from the transfer means, the heating temperature due to this transfer means is lower than that of the fixing means.

In this construction, in the transfer position, the toner image is only transferred by heat, so the toner image can be fixed by a fixing means at a higher heating temperature than the transfer means. Therefore, compared with the prior art heating simultaneous transfer and fixing method wherein transfer and fixing were performed simultaneously by the transfer means, the heating temperature of the transfer means can be set low. Consequently, image deterioration due to heat propagation from the transfer means to the image carrier can definitively be reduced. Further, compared with the prior art simultaneous pressure transfer and fixing method wherein transfer and fixing were performed simultaneously by pressure alone, the pressure in the transfer means can be set low. Hence, enlargement of apparatus, fixing creases and image broadening, etc. can be prevented. Herein, if the toner image is transferred from the latent image carrier to the transfer material and the heat supplied to the toner is lower than the glass transition temperature Tg of this toner, sufficient adhesion to this transfer material is no longer obtained. On the other hand, if it is higher than the softening temperature Tm, it fully adheres to the transfer material, but the latent image carrier and the surrounding developing means may be affected by heat, and the toner may solidify.

DESCRIPTION OF THE PREFERRED EMBODIMENTS

One embodiment which applies the present invention to an electrophotographic copier (hereafter, "copier") which is an image-forming apparatus, will now be described.

Figure 1:
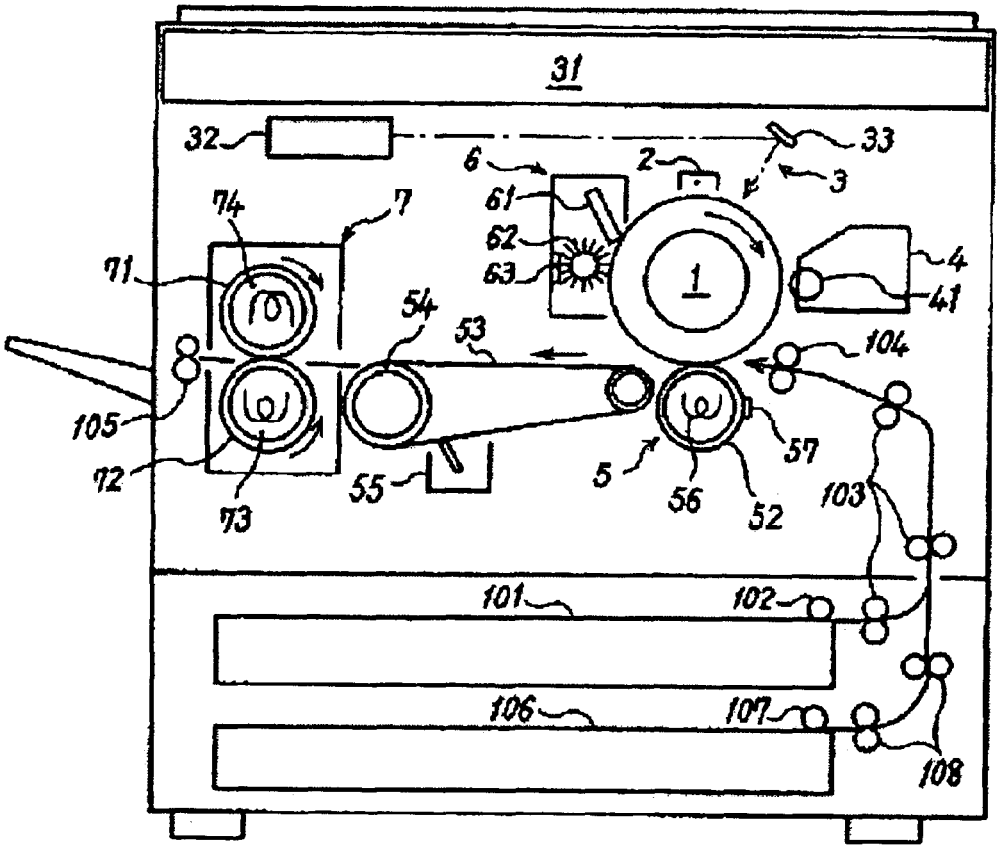
FIG. 1 is a schematic view of the essential parts of an electrophotographic copier according to one embodiment.

FIG. 1 is a schematic diagram showing an example of the copier relating to this embodiment.

Figure 2:
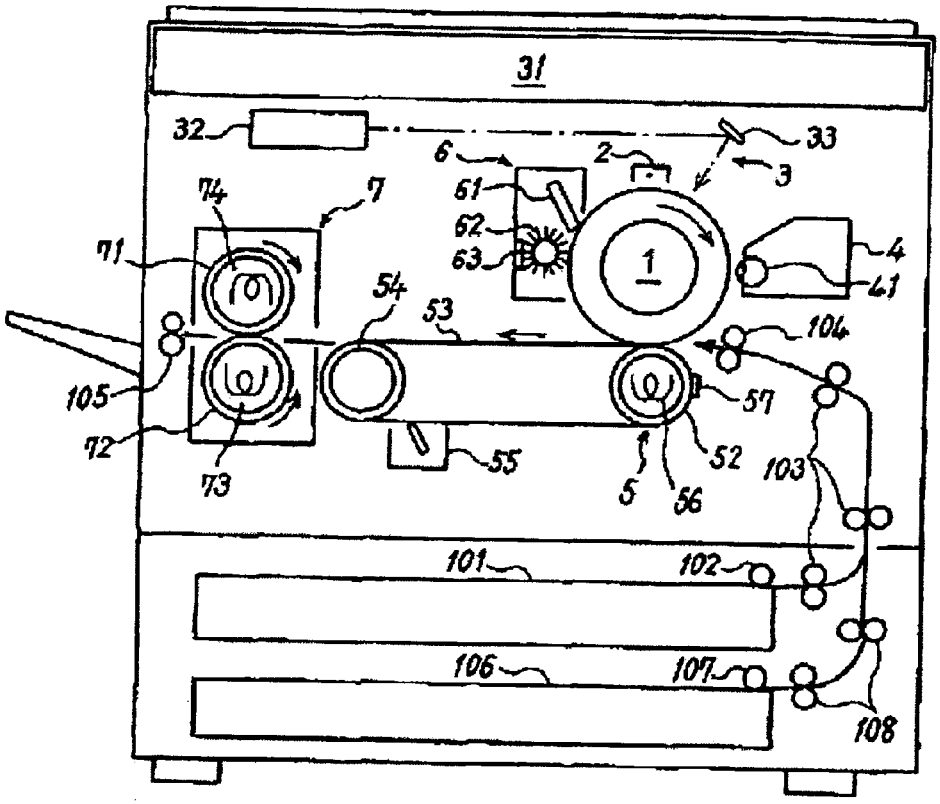
FIG. 2 is a schematic view of the essential parts of an electrophotographic copier according to another embodiment.

FIG. 2 is a schematic block diagram of a copier in another construction wherein transfer material transport properties are improved by forming the transfer apparatus 5 shown in FIG. 1 and a transport belt 53 in one piece. The remaining features of the construction are identical to those of the copier shown in FIG. 1, so their detailed explanation is omitted. Hereafter, these will be described referring to FIG. 1.

This copier is provided internally with a drum-like photoconductor 1 which is a latent image carrier using the well-known electrophotography method.

A charging apparatus 2, an exposure apparatus 3, a developing apparatus 4 as a developing means, a transfer apparatus 5 as a transfer means, a cleaning apparatus 6 and a fixing apparatus 7 as a fixing means which perform an electrophotographic copying step are arranged around the photoconductor 1, in the rotation direction shown by the arrow.

The exposure apparatus 3 converts an image signal sent from outside, such as data read by a scanner 31 and a PC, not shown, and scans with laser light by a polygon motor 32 so as to form an electrostatic latent image on the photoconductor 1 based on the image signal read via a mirror 33. This photoconductor 1 may be comprised of amorphous silicone or the like.

From the electrostatic latent image on the photoconductor 1, a toner image is formed by the developing apparatus 4, and this toner image is applied to a transfer material fed by feed rollers 102, 107 from transfer material banks 101, 106 in which the transfer material is stored, through feed runners 103, 108. The runner 104 is a resist runner for transporting transfer material in synchronism with the toner image on the photoconductor, and the transfer material is sent to the transfer apparatus 5 where it is hot transferred. The transfer material carrying the toner image is transported to a fixing apparatus 7 by the transfer belt 53 driven by a belt drive roller 54, and is discharged by a paper discharge runner 105 outside the machine.

At the same time, the non-transferred part or the soiled part of the photoconductor 1 is cleaned by the cleaning apparatus 6 comprising a cleaning blade 61, fur brush 62 and fur brush cleaning member 63, and enters the following image-forming step.

As the heat application method is used for transfer in the copier relating to this embodiment, it is advantageous to perform control so that the units in contact with the photoconductor 1 (for example, the developing apparatus 4 and cleaning apparatus 6) can move in and out of contact, and do not contact the photoconductor 1 except during image-forming. The developing apparatus 4 which carries a large amount of toner is most affected by heat. As the toner and the developer are moving at the time of image-forming, they are not easily affected by heat, but when the toner and the developer are not moving, it easily solidifies. Solidification of the toner in the developing apparatus can be prevented by making the developing apparatus 4 detached from the photoconductor 1 except during image-forming.

In the copier of this embodiment, the fixing apparatus 7 is a necessary component to completely fix the toner transferred and half-softened by the transfer apparatus 5, described in full detail later.

The fixing apparatus 7 comprises a fixing roller 71 which is provided with a heating means 74 (hereafter, "heater") such as a halogen lamp, and a pressure roller 72 which is brought into pressure contact.

The fixing roller 71 preferably has an elastic layer such as silicone rubber whose rubber hardness is of the order of 42 HS (Aska C hardness) of thickness 100–500 μm, but preferably 400 μm, on the surface of a metal core (not shown) having an outer diameter ϕ50. To prevent adhesion due to the viscosity of toner, a resin overlayer having good mold-release characteristics such as a fluoro-resin is formed. The resin overlayer comprises a PFA tube, and it preferably has a thickness of about 10–50 μm in view of mechanical deterioration. A temperature detection means is provided on the peripheral surface side of the fixing roller 71, and the heater 74 is controlled so that the surface temperature of the fixing roller 71 is maintained substantially constant in the range of about 160–200° C.

The pressure roller 72 comprises an offset prevention layer such as tetrafluoroethylene-perfluoroalkyl vinyl ether (PFA) and polytetrafluoroethylene (PTFE) on a metal core surface. The fixing roller 71 may also be provided with an elastic layer, such as silicone rubber, on the surface of a metal core (not shown), and a heater 73 may also be provided.

In the fixing apparatus 7 having the aforesaid composition, the fixing roller 71 and the pressure roller 72 are brought into pressure contact at a pressure of 2–10 $N/cm^2$ to form a fixing nip width of approximately 10 mm, and are controlled to a predetermined temperature. When the toner image on the transfer material passes between the rollers, it is thermofused under pressure, and is left as a permanent image on the transfer material on leaving the pair of rollers and cooling.

Next, the transfer apparatus 5 which is an essential feature of the copier relating to this embodiment will be described.

In the copier relating to this embodiment, although the toner image is heated by the transfer nip, it remains in the half-softened state without completely softening, and is fixed on the transfer paper (not shown) separately by the fixing apparatus 7 shown in FIG. 1. Due to this, the heating temperature of the toner image in the transfer nip can be kept lower, and the temperature rise of the photoconductor 1 due to heating can be reduced more than in the prior art. Further, the temperature rise of the cleaning apparatus 6 or the developing apparatus 4 in contact with the photoconductor 1 is also substantially suppressed, and sticking of toner therein can also be avoided without providing a cooling means.

By setting the transfer nip pressure fairly high, the toner image can be transferred by pressure alone without concurrently using heating. However, in this case, there is a drawback of crushing the toner image and causing image deterioration due to the pressure. By moderate pressure and moderate heating, a good transfer can be achieved without the use of an electrostatic method.

The metal core of the transfer roller 52 which is the pressure roller of the transfer apparatus 5 is made of aluminum of outer diameter ϕ 40, but iron or stainless steel can also be used. An elastic body of 60 Hs (on the Aska C hardness scale) is provided on the peripheral surface of this metal core. Regarding the roller 52, it is essential that the heat of the heater 56 acts on the roller surface efficiently in a short time, which makes for high speed operation and energy saving of the copier. For this purpose, the aluminum material of good thermal efficiency is formed to a thickness of 3 mm, and the elastic layer comprises a silicone layer of 100 μm thickness covered with Teflon (registered trademark) tube of 30 μm thickness. As with the effect of the photoconductor surface roughness (Rz) mentioned later, to prevent soiling of toner on the roller 52, the surface roughness (Rz) of the Teflon (registered trademark) layer is 1.5 μm.

The contact width of the transfer roller 52 with the photoconductor 1 is approximately 1.5 mm. The contact pressure (contact pressure of the photoconductor and the transfer roller) is determined by the material of the toner and the material or shape of the roller such as the hardness and contact width of the roller, but considering the intimate contact between the transfer paper and photoconductor 1, it is preferably approximately 2–100 $N/cm^2$. In this aspect, a preferred range is approximately 2–10 $N/cm^2$ or 10–100$N/cm^2$, and particularly preferred range is 20–50$N/cm^2$. In the case of the former range, the roller thickness of the transfer roller 52 can be made thinner, so the temperature drop from the heater 56 to the roller surface is small stable temperature control can be easily performed, and image deterioration due to crushing of the toner image does not easily occur. Also, the strength of the apparatus parts need only be small, so the apparatus can be made smaller. In the case of the latter range, the contact pressure is determined by the material of the toner and the material or shape of the transfer roller. Therefore, the contact pressure can be suitably selected according to the purpose. In this copier, it was set to a contact pressure of 5 $N/cm^2$.

The transfer roller 52 is an important roller for heat transferring the toner image to the transfer paper. Herein, it has the construction of an elastic body with the above hardness so as to obtain the required contact pressure and contact width.

In order to supply heat to the transfer roller 52, the heater 56 of 500W is provided.

The heater 56 is controlled by a temperature control device as temperature control means, not shown, so that the surface temperature of the transfer roller 52 is maintained effectively constant in a range of approximately 40–120° C., by a temperature detection apparatus 57 as a temperature control means. If an amorphous silicone photoconductor which is resistant to heat is used, toner having a relatively high softening temperature and glass transition temperature can be used, so the toner image heating temperature in the transfer nip (for example, the surface temperature of the transfer roller 52 in FIG. 1 or the surface temperature of the paper transport belt 53 in FIG. 2) is preferably set to approximately 70–120° C. On the other hand, if an organic photoconductor is used, it is preferred to use a toner with relatively low softening temperature and glass transition temperature, and also to set the surface temperature of the transfer roller 52 to abound 40–80° C. Transfer was also possible at the very low heating temperature of 40° C., but from a chemical viewpoint, it is preferred to set the lower limit of the heating temperature to be higher than the glass transition temperature of the toner.

In this copier, the temperature of the transfer roller 52 was set to 100° C. The temperature is always controlled while the copier is operating. In order to release heat around the photoconductor, i.e., the photoconductor 1 and the cleaning apparatus 6, an attaching and detaching mechanism, not shown, is provided so that the transfer roller 52 can be detached from the photoconductor 1 when the transfer material does not need to be in pressure contact with the photoconductor 1. Although not shown, the transfer roller 52 is usually separated from the photoconductor 1 by a gap of approximately 10 mm. To alleviate the thermal load on the photoconductor 1, the temperature at this time was controlled to 95° C., which is 5° C. lower than the temperature during transfer. When the transfer material is supplied by the feed rollers 102, 107, the transfer roller temperature is controlled to the setting of 100° C. Next, when the front end of the transfer material arrives at a position directly facing the transfer roller 52, the attaching and detaching mechanism displaces the transfer roller 52 so that the transfer roller 52 grips the transfer material and presses it against the photoconductor 1 based on a control signal from a controller unit, not shown. The contact pressure between the photoconductor 1 and transfer roller 52 at this time is approximately $5N/cm^2$. As the contact pressure is as low as approximately $5N/cm^2$, the roller thickness of the transfer roller 52 can be made smaller, the temperature drop from the built-in heater 56 to the roller surface is small, and by measuring the temperature of the roller surface by the temperature detecting apparatus 57, stable temperature control can be performed. Once the rear end of the transfer material departs from the transfer roller 52, the transfer roller 52 again detaches from the photoconductor 1 due to the attaching and detaching mechanism, the temperature being controlled to 95° C.

In the copier of FIG. 2, the transfer apparatus 5 comprises a belt 53 which is stretched over the transfer roller 52 and a tension roller 54. This construction is known as a transfer belt system.

Provided that the material of the belt 53 has the function of transporting the transfer material, any material may be used, but a heat-resistant construction is adopted in this embodiment so that even in a transfer belt system, the same kind of belt, if not common, can be used. Specifically, the base material comprises a seamless polyimide film. A fluororesin layer is provided on the outside. Alternatively, a silicone rubber layer may be provided on the film layer as necessary, and the fluororesin layer provided thereon. Concerning the material of the belt 53, various materials can also be used, but by selecting various materials having heat-resistant properties, effective results are particularly obtained in the case of the transfer belt system shown in FIG. 2. According to this embodiment, a fluororesin layer was provided on the outer side of the base material, and this is effective in ensuring that the heat of the belt is not reduced. In the copier according to this embodiment, due to the transfer method using heat as described later, it is undesirable that the transfer roller 52 has rubber as the base material as in the case of the prior art transfer roller. The belt 53 is driven by a roller 54, though a driving means is not shown, a tension acting on the belt 53. In the copier according to this embodiment, the transfer paper can also be transported without using the belt 53, so it will be appreciated that the use of the belt 53 is not indispensable.

As described above, transfer techniques using heat have been disclosed, but the difference of the copier according to this embodiment from that of the prior art, is that the heating temperature is extremely low. If it exceeds 120° C., transfer properties improve due to the high temperature, but on the other hand, some technique must be implemented to prevent thermal damage of the photoconductor 1, developing apparatus 4 and cleaning apparatus 6. Also, if the heating temperature is low, transfer cannot be performed efficiently. In order to prevent thermal damage of the photoconductor 1 and other parts while maintaining transfer efficiency, approximately 100° C. is suitable. In the copier according to this embodiment, the transfer roller 52 is heated to a temperature of 40–120° C., which could not be achieved in the prior art, and by applying pressure, toner on the photoconductor 1 is semi-softened and stably transferred to the transfer paper. As a result, there is no thermal stress given to the photoconductor 1, developing apparatus 4 or cleaning apparatus 6, and adequate transfer properties are realized.

Next, the mechanism whereby the toner image is transferred by heat from the photoconductor 1 to the transfer paper will be described.

To maintain transfer efficiency and partially soften the toner, the toner is heated to a temperature within a range from the toner glass transition temperature to the softening point. The toner then plastically deforms and adheres to the surface imperfections on the transfer paper which has poor mold-release properties due to the anchor effect. As a result, toner displaces from the photoconductor to the transfer paper, and transfer is completed.

Hence, to obtain stable transfer properties at low temperature, the photoconductor properties and toner properties are important.

First, the properties of the photoconductor 1 will be described.

The photoconductor 1 may began organic photoconductor (OPC) or an amorphous silicone photoconductor.

An amorphous silicone photoconductor has heat resistance and is not easily affected by heat from the transfer roller 52, so it may be used even in the case of a toner having a relatively high glass transition temperature and softening point, which is desirable. This photoconductor has a heat resistance of several hundred ° C. If a coating layer with kneaded polyester silica is provided on an $As_2Se_3$ photoconductor, this may be used in this embodiment without problems. An organic photoconductor comprising polycarbonate as the main raw material coated with a thin-film of amorphous carbon of the order of several $\mu$m thickness, may also be used as the charge transfer layer. Organic photoconductors are excellent from the viewpoint of low cost and universality, but as they are inferior to an amorphous silicone photoconductor from the viewpoint of heat resistance, they are more suited to transfer at low temperature using a toner having a relatively low glass transition point and softening temperature.

It is further preferred to use a photoconducting layer, and a protection layer comprising a metal oxide coated on an electrically conducting carrier. This is because in the photoconductor 1 coated with such a protection layer, peeling of the photoconductor layer does not easily occur even if pressure is applied during transfer, and stable photoconducting properties are achieved. The base material of the protection layer may be a fluororesin or a silicone resin. Further, the metal oxide contained in the protection layer may be alumina, titanium oxide, silica, barium titanate, magnesium titanate, calcium titanate, strontium titanate, zinc oxide or tin oxide. Alumina, titanium oxide and silica which have a high anti-peeling effect, are suitable.

Next, the surface roughness which is a property of the photoconductor, will be described.

In order to fix toner to the transfer material by pressure, it is required that toner sinks into surface imperfections on the transfer material. Heat transfer in this embodiment means that the toner on the photoconductor 1 is pressed between the photoconductor 1 and the transfer material, and toner displaces to the transfer material side by sinking onto the transfer material having large imperfections. In this process, a large amount of toner in direct contact with the transfer material sinks into the transfer material, and it is preferred that the toner adheres to itself to some extent due to the resin component and other toner materials in the toner. This is achieved by the action of heat and pressure during transfer, so the surface state of the photoconductor and the toner properties described later are important. If the surface of the photoconductor 1 has imperfections, not only will the transfer efficiency to the transfer material fall, but it also becomes difficult to clean the photoconductor.

The state of formation of the toner on the photoconductor after developing is also important. It is desirable that, after developing, the toner is aligned on the photoconductor in an orderly manner. If transfer is performed when the toner is aligned in an orderly manner on the photoconductor, good transfer efficiency is obtained and a high image quality can be achieved.

According to experiment, it has been found that when a toner having the characteristics of this embodiment (described later) is used, transfer is effective if the surface roughness (10-point average roughness Rz) of the transfer material is of the order of 20 μm or more. Therefore, it is required that the surface roughness of the photoconductor 1 be less than this, so an amorphous silicone photoconductor having a surface roughness (10-point average roughness) of 0.98 μm was used for the photoconductor 1 of this embodiment. From experiment, it was found that if the surface roughness (10-point average roughness Rz) of the photoconductor 1 is 4 μm or less, good transfer efficiency can be ensured with the transfer apparatus 5 of this embodiment, and there is no difficulty in cleaning the photoconductor.

The aforesaid surface roughness (10-point average roughness Rz) is defined as follows using a calculation equation based on the definition of surface roughness in JIS B 016-1994. An object to be measured (photoconductor/transfer material) is measured in the surface roughness/mode of VK-8500 (KEYENCE CORPORATION), and the average surface roughness (Rz) is calculated. A sectional view of a rough surface to a certain length is taken. Then an average line is drawn horizontally with regards to the curved line of the rough surface. Next, an average distance of five highest peaks from the average line is calculated. Similarly, five lowest points of the curved line are taken and an average distance (in absolute value) from the average line is derived. The two average distances are added and thus the 10-point average roughness (Rz) is calculated. Herein, it is important to eliminate noise components, and in this embodiment also, the roughness was computed after eliminating noise. In the aforesaid photoconductors, the surface roughness (Rz) is 0.6–1.5 μm. Regarding the transfer material, the surface roughness (Rz) of plain paper, for example Type 6000 (Ricoh Company, Ltd.), is 30–60 μm. When the transfer material is colander paper, the surface roughness (Rz) is 150 μm. As for conditions, if the toner particle diameter is "a", it is preferred that the surface roughness (Rz) of the photoconductor is [a/2] or less, and it is preferred that the surface roughness Rz of the transfer paper is [3×a] or more.

As the toner particle diameter used in this embodiment is of the order of 6 μm, the surface roughness (Rz) of the photoconductor 1 is of the order of 3 μm, and even considering present technology, the surface roughness (Rz) of the transfer material is of the order of 20 μm.

Next, regarding photoconductor properties, the surface frictional coefficient will be described.

In FIG. 1, zinc stearate 63 is contained in the cleaning apparatus 6, and the surface frictional coefficient of the photoconductor 1 attains 0.3. Due to the lubricant effect of the zinc stearate 63, cleaning properties are improved. Also, the force with which the toner adheres to the photoconductor is weakened, so the adhesive force between toner particles predominates, and transfer efficiency improves. Due to the presence of the zinc stearate 63, the transfer efficiency improved by approximately 5%.

From experiment, it was found that the surface frictional coefficient of the photoconductor 1 is preferably 0.70 or less. If the frictional coefficient is larger than 0.70, during transfer, mold-release properties of semi-molten toner with the photoconductor 1 are poor, and image quality during transfer deteriorates. In order to reduce the surface frictional coefficient of the photoconductor 1, in addition to the aforesaid zinc stearate, it has been proposed to uniformly cover the photoconductor surface with a metal salt of a fatty acid such as calcium stearate or stearic acid, but the most common method is to add it to the toner. Herein, measurement of the surface frictional coefficient of the photoconductor 1 was performed by a fully automatic frictional wear analyzer, Kyowa Surfactants Ltd. The contact was a 3 mm stainless steel sphere.

Herein, the transfer efficiency and fixing efficiency are given by the following Equation 1 and Equation 2.

$$\text{Transfer efficiency}=[\text{toner weight on transfer material/toner weight on photoconductor after developing}]\times 100\ (\%) \quad \text{[Equation 1]}$$

$$\text{Fixing efficiency}=[\text{image density after crockmeter test/image density before crockmeter test}]\times 100\ (\%) \quad \text{[Equation 2]}$$

The crockmeter test in Equation 2 is performed using the Frictional Tester Type I of JIS L 0823. Specifically, the image is scratched 10 times (back and forth) by a friction block: ϕ15 mm, and measuring cloth: white cotton cloth (IS L 0803) under a load of 8.8N. The image density before scratching (image density before crockmeter test) and image density after scratching (image density after crockmeter test) were measured by a reflection densitometer (X-Rite 508 spectral density meter, X-Rite).

If all the aforesaid photoconductor properties are fullfilled, the heat transfer effect of this embodiment is maximized, but as environmental fluctuations and temporal stability also affect the image quality, it is convenient to suitably combine the aforesaid photoconductor properties as required.

Figure 3:
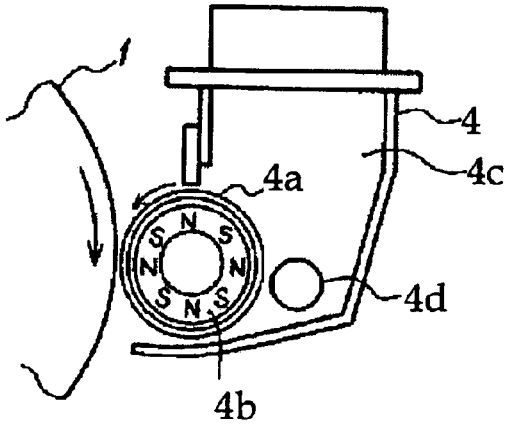
FIG. 3 is a schematic view showing a developing apparatus of a copier of an embodiment.

The aforesaid developing apparatus 4 may for example be the developing apparatus shown in FIG. 3. In the developing apparatus of FIG. 3, the developing sleeve 4*a* and part of the circumferential surface of 41 protrude from an aperture provided at a position facing the photoconductor 1. This developing sleeve 4*a* is earthed, and is rotated in an anti-clockwise direction as viewed by a drive means, not shown. A magnet roller 4*b* is fixed inside the developing sleeve 4*a* so that it does not rotate together with the sleeve. This magnet roller 4*b* comprises plural magnetic poles arranged in a circumferential surface direction. A toner container 4*c* which contains low resistance magnetic toner (hereafter, magnetic toner) having a volume resistivity of less than $1\times10^{9}$ [Ω·cm] is provided to the side of the developing sleeve 4*a*. Magnetic toner, not shown, in the toner container 4*c* is supported on the surface of the developing sleeve 4*a* by the magnetic force of the magnet roller 4*b* while being stirred by a stirrer 4*d* which is rotationally driven by a drive means, not shown. A magnetic brush of 0.5–3.0 mm is thereby formed on the developing sleeve 4*a* and transported to a position facing the photoconductor 1 (hereafter, developing position), and touches the surface of the photoconductor 1. At this time, when it comes in contact with the electrostatic latent image on the photoconductor 1, an induced charge is generated by the effect of this charge, and a toner amount corresponding to the charge amount of the electrostatic latent image electrostatically adheres to the electrostatic latent image. Due to this adhesion, the electrostatic latent image on the photoconductor 1 is developed into a toner image. The developed toner image is transferred to a transfer paper (not shown) which is a recording medium with a transfer nip described later. Hence, using low resistance magnetic toner, the developing apparatus 4 causes a magnetic toner amount corresponding to the electrostatic latent image charge amount to adhere to the electrostatic latent image, so a high-quality toner image with good half-tone reproduction can be formed. Also, an "edge effect" is not produced during developing, and the electrostatic latent image can be faithfully reproduced in its original size. However due to the low resistance there is less capacity to retain charge, so electrostatic transfer is difficult. On the other hand, high resistance toner having a high volume resistivity of $1\times10^9$ [Ω·cm] or more does not generally contain magnetic materials, so it is used in the form of a two-component developer mixed with a magnetic carrier. A two-component magnetic brush is thereby formed on the developing sleeve, but due to the effect of the electric field, an edge effect is produced. In this edge effect, not only the electrostatic image but also the surrounding area is developed so that characters and lines are broadened. Further, the magnetic carrier may scratch the developed toner image, causing blurring and image deterioration. However, as it has an excellent capacity for retaining charge, electrostatic transfer is easy.

Next, the toner properties will be described.

In the copier according to this embodiment, in the transfer apparatus 5, the toner on the photoconductor 1 is heated to a temperature within a range from the glass transition temperature to the softening point of the toner, so that plastically deformed toner adheres to the imperfections on the transfer paper by an anchor effect. When the toner image is transferred from the photoconductor 1 to the transfer paper, if the heat supplied to the toner is lower than the glass transition temperature Tg of the toner, good transfer of toner to the transfer paper is not obtained. If it is higher than the softening temperature Tm, good transfer of toner to the transfer paper is obtained, but the photoconductor 1 and the adjacent developing apparatus 4 and cleaning apparatus 6 are affected by the heat, so the toner may solidify.

In this regard, in order to obtain good transfer properties, the toner properties (physical properties) are important. Specifically, it is preferred the toner sinks into the transfer material at as low a transfer pressure and temperature as possible. It is further preferred that during developing, the toner properties are such that toner images can be formed in an orderly manner on the photoconductor.

The glass transition temperature T of the toner used in this embodiment is from 50 to 70° C. If the glass transition temperature Tg is lower than 50° C., toner storage properties are poor. On the other hand, if it is higher than 70° C., transfer and heat fixing properties during fixing in the fixing apparatus 7 are poor. When an amorphous silicone photoconductor is used, it is preferably 55–70° C., and when an organic photoconductor is used, it is preferably 50–65° C. The glass transition temperature Tg is measured according to ASTM D3418-82. The DSC curve used is obtained after a temperature rise and temperature drop, at a temperature rise rate of 10° C./min.

It is also preferred that the weight average particle diameter of the toner is 3.0 μm to 10.0 μm. The image quality is improved as the toner particle diameter is decreased, but when it is less than 3.0 μm, toner productivity is poorer and fluidity properties are much impaired, which is undesirable. On the other hand, when it is larger than 10.0 μm, image quality may deteriorate which is undesirable.

Regarding image quality, after transfer of the toner image, volume and surface area after fixing vary, and image quality deteriorates. This phenomenon is particularly obvious in digital developing, and reproducibility of independent dots is largely affected. Although the half-tone density should be uniform, if microscopic density unevenness occurs, the image will have a grainy appearance when viewed with the naked eye.

The physical estimation value of roughness is the granularity. Noise is measured by the Wiener Spectrum, which represents the frequency characteristics of the density fluctuation. Using the density fluctuation component, f(x), having the average value of 0, it may be represented by the following Equations 3 and 4.

$$F(u)=\int f(x)\exp(-2\pi iux)dx \quad \text{[Equation 3]}$$

$$WS(u)=F(u)^2 \quad \text{[Equation 4]}$$

Herein, in Equations 3 and 4, "x" is the spatial frequency.

The granularity (GS) is the integral of the product of WS and the Visual Transfer Function (VTF), and is represented by the following equation 5.

$$GS=\exp(-1.8\langle D\rangle)\int WS(u)^{1/2}VTF(u)du \quad \text{[Equation 5]}$$

Exp(−1.8<D>) in Equation 5 is a coefficient for correcting the difference between the density and the brightness perceived by the human eye. <D> represents the average value of the density. The granularity has a high correlation with the subjective appreciation of image smoothness. The image is smoother when the value of the granularity is the smaller, and conversely, the image is rougher and poorer when the value is larger.

The toner softening temperature Tm is preferably from 90 to 170° C. When the softening temperature Tm is less than 90° C., toner storage properties deteriorate. On the other hand, when it is higher than 170° C., heat fixing properties during transfer and fixing deteriorate. When an amorphous silicone photoconductor is used, it is preferably from 100 to 170° C., and when an organic photoconductor is used, it is preferably from 90 to 110° C. The softening temperature Tm is measured as follows. Specifically, 1 g of pressure-molded cylindrical toner is placed inside a nozzle of ϕ1.0 mm×length 1.0 mm, and put at an extrusion pressure of 1.9612 MPa and temperature rise rate of 6° C./min by a Flow Tester CFT-500 from Shimadzu Corporation. The temperature when ½ of the toner flows out from the nozzle is taken as the softening temperature Tm.

In the image-forming apparatus of the present invention, toners of various volume resistivities are applicable. Particularly, even low resistance toner having a volume resistivity of $1\times10^9$ Ω·cm can be used. With low resistance toner having a volume resistivity of $1\times10^9$ Ω·cm, even in a prior art image-forming apparatus, an induced charge is produced in the toner due to the charge arising when it contacts the electrostatic latent image, and a high-quality image can be developed which reproduces the density slope corresponding to the charge of the electrostatic latent image. However, it is difficult to retain charge in the low resistance toner, so it was extremely difficult to transfer the toner image on the latent image carrier by the electrostatic transfer method.

As the low resistance toner is transferred to the recording medium while pressurizing and heating by the transfer means in the image-forming apparatus of the present invention, the toner image can be transferred without a capsule toner or an electrostatic transfer method. Therefore, the high-quality toner image comprising low resistance toner can be transferred properly while avoiding image deterioration due to transfer dust without using a capsule toner. Moreover, by providing a fixing step by heating separate from the transfer step, the heating temperature in the transfer step can be set lower than in the fixing step. In this construction, in the transfer step, the toner image is only transferred by heat, and when the fixing step which applies more heat than the transfer step is performed, the toner image is definitively fixed on the recording medium. Therefore, compared to the prior art heat simultaneous transfer and fixing method wherein transfer in the transfer step was performed simultaneously with fixing, the heating temperature in the transfer step can be suppressed low. Due to this, image deterioration due to heat propagation from the transfer means to the image carrier can be definitively suppressed.

To improve granularity, the toner image on the photoconductor must be dense. In order to develop the toner image densely, the charging amount is preferably high and uniform, and to retain this charge (charging amount) in the toner, the volume resistivity of the toner must be high and is preferably $1\times10^9$ Ω·cm or more.

The volume resistivity of the toner is measured by applying a load of 6 t/cm$^2$ to 3.0 g of toner to form disk-shaped pellets of diameter 40 mm, by a TR-10C Dielectric Loss Meter (Ando Electric Co.). The frequency is 1 KHz, and the RATIO is 1×10−9.

The average sphericity of the toner is preferably 0.90 or more, but more preferably 0.92 or more. If the average sphericity is less than 0.90, the toner particles are irregular, accumulation of toner images on the photoconductor becomes uneven, and granularity is poor.

The average sphericity may be measured using a flow particle image analyzer FPIA-2100 from SYSMEX Ltd. In the measurement, a 1% NaCl aqueous solution is prepared using first grade sodium chloride and passed through a 45 μm filter. 0.1–5 ml of a surfactant, preferably an alkylbenzene sulfonate, and 1–10 mg of sample, are then added to 50–100 ml of the filtrate as dispersant. The dispersion is performed for 1 minute in an ultrasonic dispersing machine, and measurement is performed on the dispersion wherein the particle concentration has been adjusted to 5000–15,000 μl. Pictures of the dispersion were taken with a CCD. From the two-dimensional pictures of particles, those having a circular equivalent diameter of 0.6 μm or more were selected for the calculation of average sphericity, in view of the precision of the CCD pixels. Here, "circular equivalent diameter" means the diameter of a circle the area of which is the same as that of an observed particle. The average sphericity can be obtained by computing the sphericity of each particle, summing the sphericity of each particle, and dividing by the total number of particles. The sphericity of each particle can be computed by dividing the perimeter of a circle having an identical projected surface area to that of the particle image, by the perimeter of the particle image.

Toner having an average sphericity of 0.90 or more, can be prepared by crushing by mechanical impact, or by heat treatment.

The dispersion of toner particle diameters (weight average particle diameter/number average particle diameter) is preferably 1.4 or less. If the dispersion is larger than 1.4, the granularity is poor which is undesirable.

The weight average particle diameter and number average particle diameter were measured with a Coulter Multisizer from Coulter Co. The aperture diameter was 100 μm.

The temperature at which the melt viscosity of a toner is 1000 PaS is preferably from 100° C. to 170° C. If an amorphous silicone photoconductor is used, it is preferably from 100° C. to 130° C., and if an organic photoconductor is used, it is preferably from 120° C. to 170° C. According to this embodiment, the fixing by the fixing apparatus 7 normally employs two heating rollers, and the fixing temperature is from 100° C. to 200° C. When the temperature at which the toner melt viscosity is 1000 PaS is less than 120° C., offset easily occurs. On the other hand, when it is higher than 170° C., heat fixing properties in the fixing step are poor.

The melt viscosity is a value measured by a flow tester CFT-500C (Shimadzu Corporation), and the measurement is performed at an extrusion pressure of 1.9612 MPa, temperature rise rate of 6° C./min, die diameter of 1.0 mm and die length of 1.0 mm. The melt viscosity η is calculated by the following Equation 6.

$$\text{Melt viscosity } \eta=\pi D_4 P/128LQ \qquad \text{[Equation 6]}$$

In Equation 6, "P" is extrusion pressure (Pa), "D" is die diameter (mm), "L" is die length (mm), Q=X/10×A/t, "t" is, measured time (s), "X" is piston displacement amount (mm) relative to measured time "t", and "A" is cross-sectional surface area (mm$^2$) of piston. The temperature at which the melt viscosity η is 1000 PaS, was calculated.

The apparent density of the toner is preferably 0.30 g/cc or more. If it is less than 0.30 g/cc, toner cohesion becomes stronger, toner image thickness on the photoconductor 1 becomes uneven and granularity is poor. As a result, transfer properties during heat transfer deteriorate. The apparent density of the toner powder was measured using a powder tester (PTN, Hosokawa Micron).

Next, the material used in the toner of the present invention will be described in detail.

All the resins known in the art can be used as binder resins. For example, styrene, poly-α-stilstyrene, styrene-chlorostyrene copolymer, styrene-propylene copolymer, styrene-butadiene copolymer, styrene-vinyl chloride copolymer and styrene-vinyl acetate copolymer. In addition, styrene-maleic acid copolymer, styrene acrylic acid ester copolymer, styrene-methacrylic acid ester copolymer and styrene-α-methyl chloroacrylate copolymer may be mentioned. Other examples are styrene resins such as styrene-acrylonitrile-acrylate copolymer (single polymer or copolymer containing styrene or styrene substituent), polyester resin, epoxy resin, vinyl chloride resin and rosin-modified maleic resin. Further examples are phenol resin, polyethylene resin, polypropylene resin, petroleum resin, polyurethane resin, ketone resin, ethylene-ethylacrylate copolymer, xylene resin and polyvinyl butyrate resin.

In the present invention, polyester resin is particularly preferred. Polyester resin is obtained by condensation polymerization of ethyl alcohol and a carboxylic acid. The alcohol used may for example be a glycol such as ethylene glycol, a diene glycol, triethylene glycol or propylene glycol. In addition, 1,4-bis (hydroxymeta) cyclohexane and etherated bisphenols such as bisphenol A, divalent alcohol monomers, or trivalent or higher polyalcohol monomers may be mentioned. Examples of carboxylic acids are maleic acid, fumaric acid, phthalic acid, isophthalic acid, terephthalic acid, succinic acid, divalent organic acid monomers such as malonic acid, or 1,2,4-benzene tricarboxylic acid. In addition, 1,2,5-benzene tricarboxylic acid, 1,2,4-cyclohexane carboxylic acid, 1,2,4-naphthalene tricarboxylic acid and 1,2,5-hexane tricarboxylic acid may be mentioned. Further examples are tribasic and higher polybasic carboxylic acid monomers such as 1,3-dicarboxyl-2-methylene carboxypropane, and 1,2,7,8-octane tetracarboxylic acid.

The above resins can be used alone, but two or more can also be used together.

There is no particular limitation on the resin manufacturing method, i.e., block polymerization, solution polymerization, emulsion polymerization and suspension polymerization.

The toner of the present invention may include a mold release agent. The mold release agent may be any of those known in the art, in particular free fatty acid removal carnauba wax, montan wax and oxidized rice wax may be used alone or in combination. The carnauba wax may be microcrystalline, but it preferably has an acid value or 5 or less, and the particle size when it is dispersed in the toner binder is preferably 1 $\mu$m or less. Montan wax generally refers to montan wax purified from minerals, and as in the case of carnauba wax, it is preferably microcrystalline with an acid value of 5–14. Oxidized rice wax is obtained by atmospheric oxidation of rice bran wax, and its acid value is preferably 10–30. Other mold-release agents known in the art may also be used in mixture such as solid silicone wax, higher fatty acids/higher alcohols, montan ester waxes and low molecular weight polypropylene wax. The usage amount of these mold-release agents is 1–20 parts by weight, but preferably 3–10 parts by weight relative to the toner resin component.

The toner of the present invention may also contain external additives. As an example of such external additives, inorganic particulates may be used. The first order particle diameter of this inorganic particle is preferably 5 $\mu$m–2 mm, and in particular 5 $\mu$m–500 $\mu$m.

The specific surface by the BET method is preferably 20–500 $m^2/g$. The usage proportion of this inorganic particle is preferably 0.01–5% by weight but more preferably 0.01–2.0% by weight of toner. Specific examples of inorganic particles are silica, alumina, titania, barium titanate, magnesium titanate, calcium titanate, strontium titanate, zinc oxide, stannic oxide, quartz sand, clay, mica, woodstone and siliceous earth. In addition, chromium oxide, cerium oxide, iron oxide red, antimony trioxide, magnesium oxide, zirconia, barium sulfate, barium carbonate, calcium carbonate, silicon carbide and silicon nitride can be mentioned. Other examples are polymer particulates, e.g., soap-free emulsion polymers or suspension polymers, polystyrene obtained by dispersion polymerization, methacrylic acid ester or acrylic acid ester copolymers and polycondensates of silicone, benzoguanamine and nylon, and polymer particles obtained from thermosetting resins.

Additives added to these inorganic particulates may perform a surface treatment, improve hydrophobic properties, or prevent deterioration of fluid flow properties and charging properties under high humidity. Preferred examples of surface treatment agents are silane coupling agents, silylating agents, silane coupling agents having a fluoralkyl group, organic titanate coupling agents and aluminum coupling agents.

The developer of the present invention may contain a charge control agent if necessary. All the charge control agents known in the art may be used, e.g., nigrosine dyes, triphenylmethane dyes, chromium metal complex dyes, molybdic acid chelate dyes, rhodamine dyes and alkoxyamines. In addition, quaternary ammonium salts (including fluorinated quaternary ammonium salts), alkylamides, phosphorus or its compounds, tungsten or its compounds, fluorine activators, metal salts of salicylic acid and metal salts of salicylic acid derivatives may be mentioned. Specific examples are Bontron 03 which is a nigrosine dye, P-51 which is a quaternary ammonium salt, Bontron S-34 which is a metal-containing azo dye, E-82 which is an oxynapthoic acid metal complex, E-84 which is a salicylic acid metal complex and E-89 which is a phenolic condensate (Orient Chemical Industries). In addition, TP-302 and TP-415 (Hodogaya Chemical Co.) which are quaternary ammonium salt molybdenum complexes, may be mentioned. Further examples are PSY VP2038, a copy charger of a quaternary ammonium salt, PR, a copy charger of a triphenylmethane derivative, NEG VP2036, a copy charger of a quaternary ammonium salt and NX VP434 (Hoechst AG), a copy charger. Still further examples are LR-901, the boron complex LR-147 (Japan Carlit), copper phthalocyanine, perylene, quinacridon, azo dyes, and other polymer compounds containing functional groups such as sulfonate groups, carboxyl groups and quaternary ammonium salts.

As a colorant used in the present invention, all of the pigments and dyes which have been used as colorants for toners in the prior art may be used. Specific examples are iron black, ultramarine, nigrosine dye, aniline blue, Chalcoyl blue, oil black and azo oil blue, but these are not exhaustive. The usage amount of the colorant is 1–10 parts by weight, and preferably 3–7 parts by weight.

The method of manufacturing the toner of the present invention may be any of those used in the prior art, i.e., the binder resin, mold-release agent, colorant and charge-controlling agent if necessary are mixed together in a mixer, and kneaded by a kneading machine such as an extruder. Subsequently, the mixture is cooled and solidified, crushed in a jet mill, turbojet or kryptron, and then graded.

To add the aforesaid inorganic powders to the toner, a mixing device such as a super mixer or Henschel mixer is used.

The image-forming method of the present invention comprises a developing step wherein a latent image on a latent image carrier is rendered visible as a toner image by adhesion of toner, a transfer step wherein the toner image formed on the latent image carrier is transferred to a transfer material by heat and pressure, and a fixing step wherein the toner image transferred to the transfer material is fixed on the transfer material. The heating temperature in the aforesaid transfer step is within the range from a glass transition temperature (Tg) to the softening temperature (Tm) of the toner, there being no particular limitation provided that it is controlled to a temperature lower than the fixing temperature of the fixing means. This method may be implemented satisfactorily by the image-forming apparatus of the present invention.

EXAMPLES I-1 TO I-5

The method of manufacturing the toner will now be described.

[Toner 1]

(Toner ingredients)

| | |
|---|---|
| Polyester resin (weight average molecular weight: 208000, Tg: 57) | 82 parts by weight |
| Polyethylene wax (molecular weight 900) | 5 parts by weight |
| Carbon black (Mitsubishi Chemical Corporation, No. 44) | 12 parts by weight |
| Charge controlling agent (Spiron Black TR-H: Hodogaya Chemical Co., Ltd.) | 1 part by weight |

The above ingredients were kneaded at 100° C. using a two-axis extruder, crushed in an air current mill, graded to a weight average particle diameter of 9.5 μm (weight average particle diameter/number average particle diameter=1.45), and mixed with 0.15% by weight of silica (R-972, Japan Aerogel) a Henschel mixer to obtain a toner.

The softening temperature of this toner was 98° C., the volume resistivity was $9.5\times10^8$ Ω·cm, the average sphericity was 0.88, Tg was 58° C., the temperature at which the melt viscosity was 1000 PaS was 115° C., and the apparent density was 0.28 g/cc. A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer of the present invention.

[Toner 2]

(Toner ingredients)

| | |
|---|---|
| Polyester resin (weight average molecular weight: 374000, Tg: 68° C.) | 84 parts by weight |
| Polyethylene wax (molecular weight 900) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 150° C. using a two-axis extruder, crushed in an air current mill, graded to a weight average particle diameter of 4.5 μm (weight average particle diameter/number average particle diameter=1.5), and mixed with 0.5% by weight of silica (R-972, Japan Aerogel) a Henschel mixer to obtain a toner.

The softening temperature of this toner was 98° C., the volume resistivity was $7.5\times10^8$ Ω·cm, the average sphericity was 0.88, Tg was 70° C., the temperature at which the melt viscosity was 1000 PaS was 172° C., and the apparent density was 0.26 g/cc. A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer of the present invention.

[Toner 3]

(Toner ingredients)

| | |
|---|---|
| Polyester resin (weight average molecular weight: 285000, Tg: 65° C.) | 83 parts by weight |
| Polyethylene wax (molecular weight 8000) | 35 parts by weight |
| Carbon black (Mitsubishi Chemical Corporation, No. 44) | 13 parts by weight |
| Charge controlling agent (Spiron Black TR-H: Hodogaya Chemical Co., Ltd.) | 1 part by weight |

The above ingredients were kneaded at 140° C. using a two-axis extruder, crushed in an air current mill, graded to a weight average particle diameter of 5.0 μm (weight average particle diameter/number average particle diameter=1.42), and mixed with 1.0% by weight of silica (R-972, Japan Aerogel) a Henschel mixer to obtain a toner.

The softening temperature of this toner was 140° C., the volume resistivity was $5\times10^8$ Ω·cm, the average sphericity was 0.87, Tg was 66° C., the temperature at which the melt viscosity was 1000 PaS was 172° C., and the apparent density was 0.25 g/cc. A carrier comprising magnetite particles of average particle diameter 50 μm coated with methyl methacrylate resin (MMA) (film thickness 0.4 μm) was mixed with the aforesaid toner at a toner concentration of 5.0% by weight so as to obtain the developer of the present invention.

[Toner 4]

(Toner ingredients)

| | |
|---|---|
| Polyester resin (weight average molecular weight: 125000, Tg: 60° C.) | 88 parts by weight |
| Rice wax | 5 parts by weight |
| Carbon black (Mitsubishi Chemical Corporation, No. 44) | 6 parts by weight |
| Charge controlling agent (Spiron Black TR-H: Hodogaya Chemical Co., Ltd.) | 1 part by weight |

The above ingredients were kneaded at 90° C. using a two-axis extruder, crushed in an air current mill, graded to a weight average particle diameter of 4.5 μm (weight average particle diameter/number average particle diameter=1.45), and mixed with 1.0% by weight of silica (R-972, Japan Aerogel) a Henschel mixer to obtain a toner.

The softening temperature of this toner was 125° C., the volume resistivity was $2\times10^8$ Ω·cm, the average sphericity was 0.80, Tg was 59° C., the temperature at which the melt viscosity was 1000 PaS was 115° C., and the apparent density was 0.26 g/cc. A carrier comprising magnetite particles of average particle diameter 50 μm coated with methyl methacrylate resin (MMA) (film thickness 0.4 μm) was mixed with the aforesaid toner at a toner concentration of 5.0% by weight so as to obtain the developer of the present invention.

[Toner 5]

(Toner ingredients)

| | |
|---|---|
| Polyester resin (weight average molecular weight: 255000, Tg: 62° C.) | 89 parts by weight |
| Carnauba wax (average particle diameter: 300 μm) | 5 parts by weight |
| Carbon black (Mitsubishi Chemical Corporation, No. 44) | 6 parts by weight |
| Charge controlling agent (Spiron Black TR-H: Hodogaya Chemical Co., Ltd.) | 1 part by weight |

The above ingredients were kneaded at 130° C. using a two-axis extruder, crushed in a mechanical crusher, graded to a weight average particle diameter of 9.5 μm (weight average particle diameter/number average particle diameter=1.43), and mixed with 0.75% by weight of silica (R-972, Japan Aerogel) a Henschel mixer to obtain a toner.

The softening temperature of this toner was 135° C., the volume resistivity was $5\times10^8$ Ω·cm, the average sphericity was 0.95, Tg was 63° C., the temperature at which the melt viscosity was 1000 PaS was 118° C., and the apparent density was 0.26 g/cc. A carrier comprising magnetite particles of average particle diameter 50 μm coated with methyl methacrylate resin (MMA) (film thickness 0.4 μm) was mixed with the aforesaid toner at a toner concentration of 5.0% by weight so as to obtain the developer of the present invention.

[Toner 6]

| (Toner ingredients) | |
|---|---|
| Polyester resin (weight average molecular weight: 310000, Tg: 65° C.) | 70 parts by weight |
| Styrene-n-butyl acrylate copolymer (weight average molecular weight: 85000, Tg: 68° C.) | 20 parts by weight |
| Carnauba wax | 4 parts by weight |
| Carbon black (Mitsubishi Chemical Corporation, No. 44) | 5 parts by weight |
| Charge controlling agent (Spiron Black TR-H: Hodogaya Chemical Co., Ltd.) | 1 part by weight |

The above ingredients were kneaded at 130° C. using a two-axis extruder crushed in a mechanical crusher, graded to a weight average particle diameter of 8.5 μm (weight average particle diameter/number average particle diameter=1.15), and mixed with 0.75% by weight of silica (R-972, Japan Aerogel) a Henschel mixer to obtain a toner.

The softening temperature of this toner was 175° C., the volume resistivity was $8\times10^8$ Ω·cm, the average sphericity was 0.96, Tg was 66° C., the temperature at which the melt viscosity was 1000 PaS was 115° C., and the apparent density was 0.26 g/cc. A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer of the present invention.

[Toner 7]

| (Toner ingredients) | |
|---|---|
| Polyester resin (weight average molecular weight: 310000, Tg: 65° C.) | 50 parts by weight |
| Styrene-n-butyl acrylate copolymer (weight average molecular weight: 85000, Tg: 68° C.) | 47 parts by weight |
| Carnauba wax | 4 parts by weight |
| Carbon black (Mitsubishi Chemical Corporation, No. 44) | 8 parts by weight |
| Charge controlling agent (Spiron Black TR-H: Hodogaya Chemical Co., Ltd.) | 1 part by weight |

The above ingredients were kneaded at 145° C. using a two-axis extruder, crushed in a mechanical crusher, graded to a weight average particle diameter of 8.5 μm (weight average particle diameter/number average particle diameter=1.20), and mixed with 0.75% by weight of silica (R-972, Japan Aerogel) a Henschel mixer to obtain a toner.

The softening temperature of this toner was 155° C., the volume resistivity was $9\times10^8$ Ω·cm, the average sphericity was 0.95, Tg was 67° C., the temperature at which the melt viscosity was 1000 PaS was 150° C., and the apparent density was 0.26 g/cc. A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer of the present invention.

[Toner 8]

| (Toner ingredients) | |
|---|---|
| Polyester resin (weight average molecular weight: 310000, Tg: 65° C.) | 40 parts by weight |
| Styrene-n-butyl acrylate copolymer (weight average molecular weight: 85000, Tg: 68° C.) | 48 parts by weight |
| Carnauba wax (molecular weight 900) | 5 parts by weight |
| Carbon black (Mitsubishi Chemical Corporation, No. 44) | 6 parts by weight |
| Charge controlling agent (Spiron Black TR-H: Hodogaya Chemical Co., Ltd.) | 1 part by weight |

The above ingredients were kneaded at 140° C. using a two-axis extruder, crushed in a mechanical crusher, graded to a weight average particle diameter of 9.0 μm (weight average particle diameter/number average particle diameter=1.25), and mixed with 0.75% by weight of silica (R-972, Japan Aerogel) a Henschel mixer to obtain a toner.

The softening temperature of this toner was 145° C., the volume resistivity was $1\times10^8$ Ω·cm, the average sphericity was 0.94, Tg was 67° C., the temperature at which the melt viscosity was 1000 PaS was 135° C., and the apparent density was 0.35 g/cc. A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer of the present invention.

[Toner 9]

| (Toner ingredients) | |
|---|---|
| Polyester resin (weight average molecular weight: 310000, Tg: 60° C.) | 30 parts by weight |
| Styrene-n-butyl acrylate copolymer (weight average molecular weight: 85000, Tg: 65° C.) | 50 parts by weight |
| Carnauba wax | 5 parts by weight |
| Carbon black (Mitsubishi Chemical Corporation, No. 44) | 5 parts by weight |
| Charge controlling agent (Spiron Black TR-H: Hodogaya Chemical Co., Ltd.) | 1 part by weight |

The above ingredients were kneaded at 120° C. using a two-axis extruder crushed in a mechanical crusher, graded to a weight average particle diameter of 9.0 μm (weight average particle diameter/number average particle diameter=1.20), and mixed with 1.0% by weight of silica (R-972, Japan Aerogel) and 0.2% by weight of zinc stearate powder using a Henschel mixer to obtain a toner.

The softening temperature of this toner was 125° C., the volume resistivity was $8\times10^8$ Ω·cm, the average sphericity was 0.93, Tg was 62° C., the temperature at which the melt viscosity was 1000 PaS was 135° C., and the apparent density was 0.35 g/cc. A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer of the present invention.

[Toner 10]

| (Toner ingredients) | |
|---|---|
| Polyester resin (weight average molecular weight: 195000, Tg: 53° C.) | 84 parts by weight |
| Polyethylene wax (Average particle diameter: 900 μm) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 100° C. using a two-axis extruder, crushed in an air current mill, graded to a weight average particle diameter of 7.0 μm (weight average particle diameter/number average particle diameter= 1.43), and mixed with 0.3% by weight of silica (R-972, Japan Aero gel) using a Henschel mixer to obtain a toner.

The softening temperature of this toner was 95° C., the volume resistivity was $1.5\times10^8$ Ω·cm, the average sphericity was 0.80, Tg was 52° C., the temperature at which the melt viscosity was 1000 PaS was 120° C., and the apparent density was 0.26 g/cc. A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer of the present invention.

[Toner 11]

| (Toner ingredients) | |
|---|---|
| Polyester resin (weight average molecular weight: 388000, Tg: 73° C.) | 84 parts by weight |
| Polyethylene wax (Average particle diameter: 900 μm) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 160° C. using a two-axis extruder, crushed in an air current mill, graded to a weight average particle diameter of 9.0 μm (weight average particle diameter/number average particle diameter= 1.41), and mixed with 0.15% by weight of silica (R-972, Japan Aerogel) using a Henschel mixer to obtain a toner.

The softening temperature of this toner was 175° C., the volume resistivity was $1.7\times10^8$ Ω·cm, the average sphericity was 0.92, Tg was 72° C., the temperature at which the melt viscosity was 1000 PaS was 175° C., and the apparent density was 0.29 g/cc. A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer of the present invention.

Table 1 summarizes the toner properties.

TABLE 1

| | Toner softening temperature (° C.) | Volume-specific resistivity (Ω · cm) | Average sphericity | Glass transition temperature Tg (° C.) | Temperature at 1000 Pa · s (° C.) | Apparent density (g/cm$^3$) |
|---|---|---|---|---|---|---|
| Toner 1 | 98 | $9.5\times10^8$ | 0.88 | 58 | 115 | 0.28 |
| Toner 2 | 98 | $7.5\times10^8$ | 0.88 | 70 | 172 | 0.26 |
| Toner 3 | 140 | $5\times10^8$ | 0.87 | 66 | 172 | 0.25 |
| Toner 4 | 125 | $2\times10^9$ | 0.89 | 59 | 115 | 0.26 |
| Toner 5 | 135 | $5\times10^9$ | 0.95 | 63 | 118 | 0.26 |
| Toner 6 | 175 | $8\times10^{10}$ | 0.96 | 66 | 115 | 0.26 |
| Toner 7 | 155 | $9\times10^9$ | 0.95 | 67 | 150 | 0.26 |
| Toner 8 | 145 | $1\times10^{10}$ | 0.94 | 67 | 135 | 0.35 |
| Toner 9 | 125 | $8\times10^{10}$ | 0.93 | 62 | 135 | 0.35 |
| Toner 10 | 95 | $1.5\times10^8$ | 0.89 | 53 | 120 | 0.26 |
| Toner 11 | 175 | $1.7\times10^8$ | 0.92 | 72 | 175 | 0.29 |

Tests were performed using the aforesaid toners.

The apparatus used for the tests was an Imagio MF7070 from Ricoh Company, Ltd. the transfer unit of which had been modified for the tests. The unit construction is identical to the construction of the copier shown in FIG. 2. The photoconductor used in this test apparatus was an amorphous silicone photoconductor, and its surface roughness (10-point average roughness Rz) was 0.98 μm. The transfer pressure was 5N/cm$^2$ in terms of contact pressure, and the belt temperature was set to 100° C.

The fixing pressure was 9.3N/cm$^2$ in terms of contact pressure, the fixing nip width being approximately 10 mm, and the temperature was set to 175° C. Using this test apparatus, a test chart based on a gray scale comprising binary dots at 600 dpi was printed out to obtain images.

In this example, it is necessary to obtain good image quality and ensure fixing properties.

The fixing properties were evaluated by the transfer efficiency shown in Equation 1 and the fixing efficiency shown in Equation 2.

The image quality was evaluated by the granularity (GS) shown in Equation 5. Granularity was evaluated by reading the gray scale (half-tone part) formed from dots in an image printed by the test apparatus by a GenaScan 5000 scanner, Dai Nippon Screen Co., at 1000 dpi so as to obtain image data. The image data was converted to a density distribution, and granularity was evaluated by Equation 5.

The transfer efficiency, fixing efficiency and granularity in the above examples were evaluated and determined. Table 2 shows the test results. A transfer efficiency of 80% or more is shown by "Good", 60–79% is shown by "Fair" and 59% or less is shown by "Bad". The tolerance level was "Fair" or more. The level at which the fixing efficiency was 90% or more and there was no problem from the viewpoint of hot offset and cold offset is shown by "Good", and the tolerance level is shown by "Fair". The level at which the fixing efficiency was 70% or less and there was a problem from the viewpoint of hot offset or cold offset, was shown by "Bad". A granularity of 0.4 or less is shown by "Good", 0.4–0.5 is shown by "Fair" and 0.5 or more is shown by "Bad". The level at which there was no problem is "Good", and the tolerance level is "Fair".

TABLE 2

| | Toner | Transfer efficiency | Fixing efficiency | Granularity |
|---|---|---|---|---|
| Example 1 | Toner 4 | Good (98%) | Good (98%) | Bad (0.55) |
| Example 2 | Toner 6 | Fair (75%) | Bad (70%) | Good (0.38) |
| Example 3 | Toner 7 | Good (92%) | Good (94%) | Good (0.30) |
| Example 4 | Toner 8 | Good (97%) | Good (95%) | Good (0.33) |
| Example 5 | Toner 9 | Good (98%) | Good (97%) | Good (0.31) |

As described above, in a test apparatus used as an image-forming apparatus comprising a photoconductor functioning as a latent image carrier for forming a latent image on a surface, a developing apparatus functioning as a developing means for rendering the latent image visible as a toner image by adhesion of toner, a transfer apparatus functioning as a transfer means for transferring the toner image formed on the photoconductor as latent image carrier to a transfer material by heat and pressure using a transfer roller as heating roller, and a fixing apparatus functioning as a fixing means for fixing the toner image transferred to the transfer material, on the transfer material, a heater, temperature detecting apparatus and temperature controlling apparatus are provided as a temperature control means for controlling the temperature of a transfer roller, which is the heating means, within a range of from the glass transition temperature (Tg) to the softening temperature (Tm) of the toner, and less than the fixing temperature of the fixing apparatus, which is the fixing means.

The present invention has the following excellent advantages. Toner deterioration and damage to apparatus due to heat are avoided, bulkiness of apparatus, fixing creases and image broadening in the simultaneous transfer and fixing method using pressure are avoided, and image deterioration due to transfer dust is definitively suppressed without using a capsule toner. Further, as the aforesaid heating roller is used, by incorporating a heater or other heat source in the heating roller, temperature control during transfer is simple.

EXAMPLE II

Next, examples of using a low resistance toner will be described.

The Inventors manufactured 9 types of toner referred to as Developer A–Developer I, and output images using these toners. Specifically, the following 9 toner compositions, referred to as Composition A–Composition I, were prepared.

[Composition A]

| | |
|---|---|
| Polyester resin: (weight-average molecular weight: 325000, glass transition temperature Tg: 67.5° C.) | 89 parts by weight |

-continued

| | |
|---|---|
| Polyethylene wax (molecular weight 900): | 5 parts by weight |
| Magnetite particulates: | 50 parts by weight |
| Carbon black: (Ketchen Black EC, Ketchen Black International) | 3 parts by weight |
| Charge controlling agent (Spiron Black TR-H, HODOGAYA CHEMICAL CO., LTD., hereafter idem): | 1 part by weight |

[Composition B]

Identical to Composition A, except that carbon black was changed to 5 parts by weight.

[Composition C]

| | |
|---|---|
| Polyester resin: (weight-average molecular weight: 325000, glass transition temperature Tg: 67.5° C.) | 89 parts by weight |
| Polypropyrene wax: (molecular weight 8000) | 3 parts by weight |
| Magnetite particulates: | 50 parts by weight |
| Carbon black | 3 parts by weight |
| Charge controlling agent | 1 part by weight |

[Composition D]

| | |
|---|---|
| Styrene-n-butyl acrylate copolymer: (weight-average molecular weight: 55000, glass transition temperature Tg: 52° C.) | 88 parts by weight |
| Rice wax: | 5 parts by weight |
| Magnetite particulates: | 50 parts by weight |
| Carbon black: | 3 parts by weight |
| Charge controlling agent: | 1 part by weight |

[Composition E]

| | |
|---|---|
| Polyester resin: (weight-average molecular weight: 280000, Tg: 61° C.) | 89 parts by weight |
| Magnetite particulates: | 50 parts by weight |
| Carnauba wax (average particle diameter: 300 μm) | 5 parts by weight |
| Carbon black | 3 parts by weight |
| Charge controlling agent: | 1 part by weight |

[Composition F]

| | |
|---|---|
| Polyester resin: (weight average molecular weight: 310000, glass transition temperature Tg: 68° C.) | 70 parts by weight |
| Styrene-n-butyl acrylate copolymer: (weight-average molecular weight: 85000, Tg: 60° C.) | 20 parts by weight |
| Magnetite particulates: | 50 parts by weight |
| Carnauba wax: | 4 parts by weight |
| Carbon black: | 3 parts by weight |
| Charge controlling agent: | 1 part by weight |

[Composition G]

| | |
|---|---|
| Polyester resin: (weight-average molecular weight: 310000, Tg: 68° C.) | 50 parts by weight |
| Styrene-n-butyl acrylate copolymer: | 47 parts by weight |
| Magnetite particulates: (weight-average molecular weight: 85000, Tg: 60° C.) | 50 parts by weight |
| Carnauba wax: | 5 parts by weight |
| Carbon black | 3 parts by weight |
| Charge controlling agent: | 1 part by weight |

[Composition H]

| | |
|---|---|
| Polyester resin: (weight-average molecular weight: 310000, Tg: 68° C.) | 40 parts by weight |
| Styrene-n-butyl acrylate copolymer: (weight-average molecular weight: 85000, Tg: 60° C.) | 48 parts by weight |
| Magnetite particulates: | 50 parts by weight |
| Carnauba wax: | 5 parts by weight |
| Carbon black | 3 parts by weight |
| Charge controlling agent: | 1 part by weight |

-continued

| [Composition I] | |
|---|---|
| Polyester resin: (weight-average molecular weight: 310000, Tg: 68° C.) | 40 parts by weight |
| Styrene-n-butyl acrylate copolymer: (weight-average molecular weight: 85000, Tg: 60° C.) | 48 parts by weight |
| Magnetite particulates: | 50 parts by weight |
| Carnauba wax: | 5 parts by weight |
| Carbon black | 3 parts by weight |
| Charge controlling agent: | 1 part by weight |

These compositions A–I were separately kneaded at a temperature Tt using a two-axis extruder, crushed in an air current mill, and graded to a weight average particle diameter of ϕt. The powder was then mixed with an amount Mt of silica (R-972, Japan Aerogel) using a Henschel mixer to give the toners A–I. In the case of toner I, 0.2% by weight of zinc stearate powder was added together with the silica. The compositions, kneading temperature Tt, weight average particle diameter ϕt and silica mixing amount Mt of each toner are shown in the following Table 3.

TABLE 3

| | Composition | Kneading temperature Tt(C) [° C.] | Weight average particle diameter ϕt [μm] | ϕt/number average particle diameter (dispersion) | Silica mixing amount Mt [% by weight] |
|---|---|---|---|---|---|
| Toner A | A | 70 | 7.0 | 1.35 | 0.5 |
| Toner B | B | 70 | 7.0 | 1.35 | 0.5 |
| Toner C | C | 140 | 5.0 | 1.20 | 0.5 |
| Toner D | D | 90 | 6.0 | 1.29 | 0.5 |
| Toner E | E | 140 | 9.5 | 1.10 | 0.5 |
| Toner F | F | 140 | 8.5 | 1.15 | 0.4 |
| Toner G | G | 140 | 9.0 | 1.25 | 0.5 |
| Toner H | H | 140 | 9.0 | 1.25 | 0.8 |
| Toner I | I | 140 | 9.0 | 1.25 | *1.0 |

*Contains 0.2% by weight of zinc stearate powder in addition to 1.0% by weight of silica.

The weight average particle diameter ϕt in Table 3 is only an average value, and in an actual toner powder, a relatively wide particle size distribution was found. For reference, examples of toner particle size distribution are shown in Table 4. This particle size distribution was measured by a Coulter MULTISIZER"e with an aperture of 100 μm. From the measurement results of particle size distribution, the dispersion (ϕt/number average particle diameter) of the toner in Table 3 was computed.

TABLE 4

| Particle size range [μm] | Weight % | Number % |
|---|---|---|
| 1.59–1.99 | 0.00 | 0.00 |
| 2.00–2.51 | 0.51 | 6.29 |
| 2.52–3.16 | 2.03 | 12.63 |
| 3.17–3.99 | 6.02 | 19.26 |
| 4.00–5.03 | 14.84 | 24.04 |
| 5.04–6.34 | 26.47 | 21.62 |
| 6.35–7.99 | 28.37 | 12.10 |
| 8.00–10.0 | 15.52 | 3.48 |
| 10.1–12.6 | 4.64 | 0.53 |
| 12.7–15.9 | 0.86 | 0.05 |
| 16.0–20.1 | 0.27 | 0.01 |
| 20.2–25.3 | 0.00 | 0.00 |
| 25.4–32.0 | 0.00 | 0.00 |

Table 5 shows the toner properties.

TABLE 5

| | Volume-specific resistivity [Ωcm] | Average sphericity | Glass transition temperature Tg [° C.] | Softening temperature [° C.] | Temperature at viscosity of 1000 [° C.] | Apparent density [g/cm$^3$] |
|---|---|---|---|---|---|---|
| Toner A | $9.0 \times 10^8$ | 0.88 | 67 | 115 | 135 | 0.45 |
| Toner B | $8.0 \times 10^7$ | 0.88 | 67 | 115 | 135 | 0.45 |
| Toner C | $1.5 \times 10^9$ | 0.87 | 67 | 113 | 132 | 0.48 |
| Toner D | $1.5 \times 10^8$ | 0.95 | 49 | 89 | 98 | 0.47 |
| Toner E | $1.5 \times 10^8$ | 0.98 | 52 | 120 | 132 | 0.46 |
| Toner F | $1.5 \times 10^8$ | 0.96 | 64 | 105 | 132 | 0.49 |
| Toner G | $1.5 \times 10^8$ | 0.95 | 63 | 100 | 120 | 0.48 |
| Toner H | $1.5 \times 10^8$ | 0.94 | 61 | 98 | 105 | 0.53 |
| Toner I | $1.5 \times 10^8$ | 0.94 | 61 | 98 | 105 | 0.54 |

To output images, an Imagio MF5570 from Ricoh Company, Ltd. was modified to make the test apparatus shown in FIG. 1, and the aforesaid toners A–I were set in this apparatus to perform tests. The image was a test chart containing a gray scale formed of binary dots at 600 dpi. The fixing temperature in the fixing part 45 was set to 165° C. The belt temperature (heat transfer temperature) in the transfer nip was set to 70° C. The adhesion amount of silica or zinc stearate powder to the photoconductor 1 differed depending on the type of toner used, so the coefficient of friction of the photoconductor 1 was measured for each test. The following Table 6 shows the relation between the type of toner in the test and the coefficient of friction of the photoconductor.

TABLE 6

| Test | Type of toner | Coefficient of friction of photoconductor |
|---|---|---|
| Test A | Toner A | 0.75 |
| Test B | Toner B | 0.75 |
| Test C | Toner C | 0.73 |
| Test D | Toner D | 0.72 |
| Test E | Toner E | 0.75 |
| Test F | Toner F | 0.73 |

TABLE 6-continued

| Test | Type of toner | Coefficient of friction of photoconductor |
|---|---|---|
| Test G | Toner G | 0.71 |
| Test H | Toner H | 0.72 |
| Test I | Toner I | 0.50 |

Next, the Inventors tested the granularity for the images obtained in the Tests A–G shown in Table 6. Specifically, a gray scale of the test chart image after fixing was read by a scanner (GenaScan 5000), Dai Nippon Screen Co., at a resolution of 1000 dpi, so as to obtain image data. The obtained image data was converted to a density distribution, and the granularity was calculated using the aforesaid Equation 3. In the prior art simultaneous heat transfer and fixing method, the best granularity that could be obtained was of the order of 0.4–0.5. Therefore, if the granularity is less than 0.4, the result is better than that of the prior art, and if it exceeds 0.5, it is worse than that of the prior art.

Table 7 shows the test results for granularity.

TABLE 7

| Test | Granularity |
|---|---|
| Test A | 0.45 |
| Test B | 0.35 |
| Test C | 0.39 |
| Test D | 0.42 |
| Test E | 0.38 |
| Test F | 0.35 |
| Test G | 0.33 |
| Test H | 0.25 |
| Test I | 0.24 |

As shown in Table 7, in tests A–I, equivalent or superior image quality (granularity) to that of the prior art simultaneous heat transfer and fixing method is obtained in every case. The reason why better image quality than in the prior art is obtained, is presumed as follows. In the prior art simultaneous heat transfer and fixing method as the toner is heated above the softening temperature in the transfer nip, a slight hot offset is produced relative to the photoconductor 1 when the transfer paper (not shown) and photoconductor 1 are separated. On the other hand, in tests A–I, the heat transfer temperature (belt temperature in the transfer nip) is set to 70° C., and as can be seen from a comparison with the softening temperature Tm shown in Table 5 the toner is heated to a lower temperature than the softening temperature Tm in the transfer nip in every case. The toner is therefore transferred without being completely softened. Due to this, hot offset is suppressed and image quality improves. Consequently, in the test apparatus according to this embodiment, equivalent or superior image quality to that of the prior art simultaneous heat transfer and fixing method is obtained.

In Table 7, in test I, the best image quality with a granularity of 0.24 is obtained. This is considered to be due to the use of zinc stearate in addition to silica as the additive which lowered the coefficient of friction between the photoconductor 1 and the toner to 0.5, which is less than 0.7, and further suppressed offset to the photoconductor 1. On the other hand, the coefficient of friction exceeds 0.7 in all the other tests. Therefore, it may be said that the coefficient of friction should be suppressed to 0.7 or less. A toner I' which was identical to the toner I except that zinc stearate powder was not added, was prepared, and when images were output using this toner, the coefficient of friction exceeded 0.7 and the granularity deteriorated. Also, as shown in FIG. 1, using a drum cleaning apparatus 10 comprising a zinc stearate block 10*a*, and a brush 10*b* which shaves the block and applies it onto the photoconductor 1, the coefficient of friction dropped to 0.5. Hence, an identical granularity to that of test I could be obtained using toner I'.

In the copier according to this embodiment, by using an organic photoconductor as the photoconductor 1, using an organic photoconductor which is economical and environmentally stable, stable charging can be uniformly performed to form a latent image. Also, by developing by electrostatic induction using a magnetic, low resistance toner of less than $1\times10^9$ Ω·cm in the developing step, a good-quality toner image faithful to the latent image can be rendered visible on the photoconductor.

By arranging the transfer fixing unit 5 which is the transfer means to give a contact pressure of 2–10N/cm$^2$ to the toner image on the photoconductor 1, the following effects can be obtained. Specifically, while suppressing transfer defects due to insufficient nip contact pressure, deterioration of the toner image due to an excessive nip contact pressure can be suppressed.

If the toner has a dispersion (weight average particle diameter/number average particle diameter) of 1.3 or less, pressure can be applied uniformly to the toner particles by the transfer nip and scatter in transfer properties can be suppressed.

If the toner has an average sphericity of 0.9 or more, non-uniformity of toner cohesion properties due to irregular shapes of toner particles leading to deterioration of heat transfer properties, can be suppressed.

If the toner has a glass transition temperature Tg of 50–65° C., deterioration in toner storage properties in a high temperature environment can be suppressed, and deterioration of transfer properties due to an excessively high toner glass transition temperature Tg can be suppressed.

If the toner has a softening temperature Tm of 90–100° C., deterioration in toner storage properties in a high temperature environment can be suppressed, and deterioration of transfer properties due to an excessively high toner softening temperature Tm can be suppressed.

If the photoconductor 1 which is the image carrier has a surface coefficient of friction of 0.70 or less, or if a lubricant coating means is provided to coat the photoconductor 1 with a lubricant, image deterioration such as offset due to poor mold-release properties between the toner which is in a semi-softened state and the photoconductor 1 due to the transfer nip, can be suppressed.

If the photoconductor which is the image carrier comprises a photoconducting layer which is the base layer laminated with a metal oxide, film peeling of the photoconducting layer in the transfer nip can be suppressed, and stable photoconducting properties can be realized.

EXAMPLE III

Next, examples of an image-forming apparatus and an image forming method according to the present invention, wherein a pressure of 10–100N/cm$^2$ is applied between the transfer roller and photoconductor, will be described.

As the developer used in Example III, 10 types of developers A–J were prepared.

Developer A

| (Toner ingredients) | |
|---|---|
| Polyester resin (weight average molecular weight: 52000, Tg: 54° C.) | 82 parts by weight |
| Polyethylene wax (molecular weight 900) | 5 parts by weight |
| Carbon black (Mitsubishi Chemical Corporation, No. 44) | 12 parts by weight |
| Charge controlling agent (Spiron Black TR-H: Hodogaya Chemical Co., Ltd.) | 1 part by weight |

The above ingredients were kneaded at 80° C. using a two-axis extruder, crushed in an air current mill, graded to a weight average particle diameter of 9.5 μm (weight average particle diameter/number average particle diameter= 1.45), and mixed with 0.25% by weight of silica (R-972, Japan Aerogel) using a Henschel mixer to obtain the following toner.

Tg of this toner was 53° C., Tm was 98° C., the volume resistivity was $9.5\times10^8$ Ω·cm, the average sphericity was 0.91, the temperature at which the melt viscosity was 1000 PaS was 115° C., and the apparent density was 0.28 g/ml.

A carrier comprising magnetite particles of average particle diameter 50 μm coated with methyl methacrylate resin (MMA) (film thickness 0.5 μm), was mixed with the aforesaid toner at a toner concentration of 5.0% by weight so as to obtain the developer A of the present invention.

Developer B

| (Toner ingredients) | |
|---|---|
| Polyester resin (weight average molecular weight: 182500, Tg: 71° C.) | 82 parts by weight |
| Polyethylene wax (molecular weight 1200) | 5 parts by weight |
| Carbon black (Mitsubishi Chemical Corporation, No. 44) | 12 parts by weight |
| Charge controlling agent (Spiron Black TR-H: Hodogaya Chemical Co., Ltd.) | 1 part by weight |

The above ingredients were kneaded at 160° C. using a two-axis extruder, crushed in an air current mill, graded to a weight average particle diameter of 9.5 μm (weight average particle diameter/number average particle diameter= 1.42), and mixed with 0.25% by weight of silica (R-972, Japan Aerogel) using a Henschel mixer to obtain a toner.

Tg of this toner was 71° C., Tm was 165° C., the volume resistivity was $8.5\times10^8$ Ω·cm, the average sphericity was 0.91, the temperature at which the melt viscosity was 1000 PaS was 175° C., and the apparent density was 0.29 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer B of the present invention.

Developer C

| (Toner ingredients) | |
|---|---|
| Polyester resin (weight average molecular weight: 52000, Tg: 54° C.) | 45 parts by weight |
| Styrene-butyl acrylate copolymer (weight average molecular weight: 105000, Tg: 58° C.) | 40 parts by weight |
| Polypropylene wax (VISCOL 550P: Sanyo Chemical Industries, Ltd.) | 4 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 100° C. using a two-axis extruder, crushed in an air current mill, graded to a weight average particle diameter of 8.5 μm (weight average particle diameter/number average particle diameter= 1.45), and mixed with 0.50% by weight of silica (R-972, Japan Aerogel) using a Henschel mixer to obtain a toner.

Tg of this toner was 56° C., Tm was 105° C., the volume resistivity was $9.5\times10^8$ Ω·cm, the average sphericity was 0.91, the temperature at which the melt viscosity was 1000 PaS was 118° C., and the apparent density was 0.29 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer C of the present invention.

Developer D

| (Toner ingredients) | |
|---|---|
| Polyester resin (weight average molecular weight: 182500, Tg: 71° C.) | 65 parts by weight |
| Styrene-butyl acrylate copolymer (weight average molecular weight: 105000, Tg: 58° C.) | 20 parts by weight |
| Polypropylene wax (VISCOL 550P: Sanyo Chemical Industries, Ltd.) | 4 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 150° C. using a two-axis extruder, crushed in an air current mill, graded to a weight average particle diameter of 8.5 μm (weight average particle diameter/number average particle diameter= 1.42), and mixed with 0.50% by weight of silica (R-972, Japan Aerogel) using a Henschel mixer to obtain a toner.

Tg of this toner was 68° C., Tm was 155° C., the volume resistivity was $7.5\times10^8$ Ω·cm, the average sphericity was 0.90, the temperature at which the melt viscosity was 1000 PaS was 172° C., and the apparent density was 0.29 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer D of the present invention.

Developer E

| (Toner ingredients) | |
|---|---|
| Polyester resin (weight average molecular weight: 182500, Tg: 71° C.) | 35 parts by weight |
| Styrene-butyl acrylate copolymer (weight average molecular weight: 105000, Tg: 58° C.) | 49 parts by weight |
| Polypropylene wax (VISCOL 550P: Sanyo Chemical Industries, Ltd.) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 120° C. using a two-axis extruder, crushed in an air current mill, graded to a weight average particle diameter of 7.0 μm (weight average particle diameter/number average particle diameter=1.46), and mixed with 0.75% by weight of silica (R-972, Japan Aerogel) using a Henschel mixer to obtain a toner.

Tg of this toner was 65° C., Tm was 150° C., the volume resistivity was $5.5\times10^{8}$ Ω·cm, the average sphericity was 0.90, the temperature at which the melt viscosity was 1000 PaS was 125° C., and the apparent density was 0.29 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer E of the present invention.

Developer F

| (Toner ingredients) | |
|---|---|
| Polyester resin (weight average molecular weight: 182500, Tg: 71° C.) | 60 parts by weight |
| Styrene-butyl acrylate copolymer (weight average molecular weight: 105000, Tg: 58° C.) | 24 parts by weight |
| Polypropylene wax (VISCOL 550P: Sanyo Chemical Industries, Ltd.) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 140° C. using a two-axis extruder, crushed in an air current mill, graded to a weight average particle diameter of 7.0 μm (weight average particle diameter/number average particle diameter=1.46), and mixed with 0.75% by weight of silica (R-972, Japan Aerogel) using a Henschel mixer to obtain a toner.

Tg of this toner was 65° C., Tm was 150° C., the volume resistivity was $7.5\times10^{8}$ Ω·cm, the average sphericity was 0.90, the temperature at which the melt viscosity was 1000 PaS was 165° C., and the apparent density was 0.29 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer F of the present invention.

Developer G

| (Toner ingredients) | |
|---|---|
| Polyester resin (weight average molecular weight: 182500, Tg: 71° C.) | 58 parts by weight |
| Styrene-butyl acrylate copolymer (weight average molecular weight: 105000, Tg: 58° C.) | 26 parts by weight |
| Polypropylene wax (VISCOL 550P: Sanyo Chemical Industries, Ltd.) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 140° C. using a two-axis extruder, crushed in a mechanical crusher, graded to a weight average particle diameter of 7.5 μm (weight average particle diameter/number average particle diameter=1.41), and mixed with 0.75% by weight of silica (R-972, Japan Aerogel) using a Henschel mixer to obtain a toner.

Tg of this toner was 65° C., Tm was 153° C., the volume resistivity was $8.5\times10^{8}$ Ω·cm, the average sphericity was 0.95, the temperature at which the melt viscosity was 1000 PaS was 152° C., and the apparent density was 0.29 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer G of the present invention.

Developer H

| (Toner ingredients) | |
|---|---|
| Polyester resin (weight average molecular weight: 182500, Tg: 71° C.) | 60 parts by weight |
| Styrene-butyl acrylate copolymer (weight average molecular weight: 105000, Tg: 58° C.) | 24 parts by weight |
| Carnauba wax | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 135° C. using a two-axis extruder, crushed in a mechanical crusher, graded to a weight average particle diameter of 6.5 μm (weight average particle diameter/number average particle diameter=1.35), and mixed with 1.00% by weight of silica (R-972, Japan Aerogel) using a Henschel mixer to obtain a toner.

Tg of this toner was 65° C., Tm was 150° C., the volume resistivity was $9.5\times10^{8}$ Ω·cm, the average sphericity was 0.96, the temperature at which the melt viscosity was 1000 PaS was 145° C., and the apparent density was 0.29 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer H of the present invention.

| Developer I | |
|---|---|
| (Toner ingredients) | |
| Polyester resin (weight average molecular weight: 182500, Tg: 71° C.) | 60 parts by weight |
| Styrene-butyl acrylate copolymer (weight average molecular weight: 105000, Tg: 58° C.) | 27 parts by weight |
| Carnauba wax | 5 parts by weight |
| Carbon black (Mitsubishi Chemical Corporation, No. 44) | 7 parts by weight |
| Charge controlling agent (Spiron Black TR-H: Hodogaya Chemical Co., Ltd.) | 1 part by weight |

The above ingredients were kneaded at 130° C. using a two-axis extruder, crushed in an air current mill, graded to a weight average particle diameter of 6.5 μm (weight average particle diameter/number average particle diameter 1.35), and mixed with 1.00% by weight of silica (R-972, Japan Aerogel) using a Henschel mixer to obtain a toner.

Tg of this toner was 62° C., Tm was 150° C., the volume resistivity was $2.5\times10^9$ Ω·cm, the average sphericity was 0.97, the temperature at which the melt viscosity was 1000 PaS was 145° C., and the apparent density was 0.29 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer I of the present invention.

| Developer J | |
|---|---|
| (Toner ingredients) | |
| Polyester resin (weight average molecular weight: 182500, Tg: 71° C.) | 60 parts by weight |
| Styrene-butyl acrylate copolymer (weight average molecular weight: 105000, Tg: 58° C.) | 27 parts by weight |
| Carnauba wax (VISCOL 550P: Sanyo Chemical Industries, Ltd.) | 5 parts by weight |
| Carbon black (Mitsubishi Chemical Corporation, No. 44) | 7 parts by weight |
| Charge controlling agent (Spiron Black TR-H: Hodogaya Chemical Co., Ltd.) | 1 part by weight |

The above ingredients were kneaded at 130° C. using a two-axis extruder, crushed in an air current mill, graded to a weight average particle diameter of 6.5 μm (weight average particle diameter/number average particle diameter= 1.35), and mixed with 1.50% by weight of silica (R-972, Japan Aerogel) using a Henschel mixer to obtain a toner.

Tg of this toner was 62° C., Tm was 150° C., the volume resistivity was $2.5\times10^9$ Ω·cm, the average sphericity was 0.975, the temperature at which the melt viscosity was 1000 PaS was 145° C., and the apparent density was 0.35 g/ml.

A carrier comprising magnetite particles of average particle diameter 50 μm coated with methyl methacrylate resin (MMA) (film thickness 0.5 μm) was mixed with the aforesaid toner at a toner concentration of 5.0% by weight so as to obtain the developer J of the present invention.

Next, in the image-forming apparatus of the present invention shown in FIG. 1, images were formed using the aforesaid developers A–J, and transfer efficiency, fixing properties and granularity were evaluated from these images.

The transfer efficiency was evaluated by measuring the weight of toner on the photoconductor and the weight of toner on the transfer paper when a 2.5 cm×2.5 cm pattern with a black solid fills was formed, by the equation shown below.

Transfer efficiency=[weight of toner on transfer paper after transfer/weight of toner on photoconductor after developing]×100 [%]

The higher the transfer efficiency is, the better the performance is. The results were determined according to the following criteria:

Good: transfer efficiency 80% or more

Fair: transfer efficiency 60–79%

Bad: transfer efficiency 59% or less

To evaluate fixing properties, a sample was first obtained by printing a binary half-tone image. A mending tape (3M) was affixed to the obtained sample and after applying a constant pressure, gently peeled off. The image density before and after was measured by a Macbeth densitometer, and the fixing properties were computed by the following equation:

Fixing efficiency=[image density after peeling off mending tape/image density before peeling off mending tape]×100%

Good: fixing efficiency 85% or more

Fair: fixing efficiency 75–84%

Bad: fixing efficiency 74% or less

Granularity is a physical measure of roughness. To evaluate the granularity, a sample was first obtained by printing a half-tone binary image. Next, this was read by a GenaScan 5000 scanner, Dai Nippon Screen Co., at 1000 dpi so as to obtain image data. The image data was converted to a density distribution, and noise was measured by the Wiener Spectrum (WS), which represents the frequency characteristics of the density fluctuation. Using the density fluctuation component, f(x), having the average value of 0:

$$F(u)=\int f(x)\exp(-2\pi iux)dx$$

$$WS(u)=F(u)^2$$

The granularity (GS) was evaluated from WS by the following equation:

$$GS=\exp(-1.8\langle D\rangle)\int WS(u)^{1/2}VTF(u)du$$

where, VTF are visual frequency characteristics. The noise component of the density fluctuation is multiplied by human subjectivity to make the value compatible with a subjective evaluation. Exp(−1.8<D>) is a correction coefficient using the average density <D> of the image. This coefficient corrects for the fact that human sensitivity to visual roughness is higher as the average density becomes lower.

Granularity has a high correlation with subjective appreciation of image smoothness. The smaller the value is the smoother and higher the image quality is, and conversely, the larger the value is, the rougher and poorer the image quality is.

| | |
|---|---|
| Very Good: | 0.20 or less |
| Good: | 0.21–0.35 |
| Fair: | 0.36–0.50 |
| Bad: | 0.51–0.70 |
| Very Bad: | 0.71 or more |

EXAMPLE III-1

Using developer G, the test apparatus was a digital copier MF7070 from Ricoh Company, Ltd. with a modified transfer unit as shown in FIG. 1. After developing with the two-component magnetic brush developing apparatus 4, a transfer step was performed with concurrent use of heat and pressure by the transfer apparatus 5. The transfer pressure during transfer was 50N/cm$^2$ in terms of contact pressure, and the belt temperature was set to 120° C.

In the following fixing step by the fixing apparatus 7, fixing was performed by applying pressure to the toner with a contact pressure of 9.3N/cm$^2$, the fixing nip width being approximately 10 mm, and the temperature was set to 175° C.

Using this test apparatus, a test chart based on a gray scale comprising binary dots at 600 dpi was printed out to obtain an image.

An optimization test of this transfer method was performed under the following conditions.

The toner particle diameter (weight average) of the developer used in the developing apparatus 4 was 7.5 μm, and three photoconductors 1 having different surface roughnesses (photoconductor roughnesses) Rz, 2.5 μm, 3.1 μm and 4.8 μm, were prepared. Using amorphous silicone photoconductors for the photoconductor 1, each surface was buffed with a metal oxide powder to obtain a desired roughness. Three types of transfer paper having different surface roughnesses (paper roughnesses) Rz, 8 μm, 15 μm and 24 μm, were also prepared. Each transfer paper having the desired surface roughness was selected from coated and plain papers.

The surface roughness was measured by the line roughness measurement mode using a VK8500 from KEYENCE CORPORATION. Table 8 shows the result for transfer efficiency.

TABLE 8

| Photoconductor | Paper roughness | | |
|---|---|---|---|
| roughness | 8 [μm] | 15 [μm] | 24 [μm] |
| 2.5 [μm] | Bad | Good | Good |
| 3.1 [μm] | Bad | Good | Good |
| 4.8 [μm] | Bad | Bad | Good |

According to Table 8, when the photoconductor roughness is small or the transfer paper roughness is large, transfer efficiency improves, and it was found that, where the toner particle diameter is a, the roughness Rz of the photoconductor was preferably [a/2] or less, and the roughness Rz of the transfer, paper was preferably [2×a] or more. This is presumably due to the increased toner adhesive force of the transfer paper because of the increased anchor effect of transfer paper fibers when the transfer paper roughness is large and due to better mold-release properties of the semi-molten toner during transfer when the photoconductor roughness is small.

EXAMPLE III-2

As in the case of Example III-1, a digital copier MF7070 from Ricoh Company, Ltd. in FIG. 1 having a modified transfer unit was used with the developer G. Using a photoconductor 1 having a photoconductor roughness Rz of 3.1 μm and a transfer paper having a paper roughness of 15 μm, the image was developed with the two-component magnetic brush developing apparatus 4, heat and pressure were applied during transfer by the transfer apparatus 5 to transfer the toner image to the transfer paper, and heat roller fixing was performed by the fixing apparatus 7.

In the following fixing step by the fixing apparatus 7, fixing was performed by applying pressure to the toner with a contact pressure of 9.3N/cm$^2$, the fixing nip width being approximately 10 mm, and the temperature was set to 175° C.

Using this test apparatus, a test chart based on a gray scale comprising binary dots at 600 dpi was printed out to obtain an image.

The surface temperature of the transfer belt 53 during transfer was set to 4 levels, i.e., 50° C., 70° C., 120° C. and 150° C., the pressure was set to 5 levels, i.e., 5N/cm$^2$, 10N/cm$^2$, 50N/cm$^2$, 100N/cm$^2$, 150N/cm$^2$, and test charts were printed.

The transfer efficiency was evaluated as in Example III-1. Table 9 shows the results.

TABLE 9

| | Pressure | | | | |
|---|---|---|---|---|---|
| Temperature | 5 [N/cm$^2$] | 10 [N/cm$^2$] | 50 [N/cm$^2$] | 100 [N/cm$^2$] | 150 [N/cm$^2$] |
| 50 [° C.] | Bad | Bad | Bad | Fair | Fair (Curl) |
| 80 [° C.] | Bad | Good | Good | Good | Good (Curl) |
| 130 [° C.] | Bad | Good | Good | Good | Good (Curl) |
| 170 [° C.] | Bad | Fair | Fair | Fair | Fair (Curl) |

From Table 9, good results were obtained when the applied pressure was 10–100N/cm$^2$ and the applied temperature was 80–130° C. This applied temperature of 80–130° C. was within the temperature range from the glass transition temperature Tg (65° C.) to the toner softening point Tm (153° C.) of the toner in the developer G which was used.

Discussing this result, when the pressure is small, sufficient heat probably does not reach the toner layer, so the toner does not become semi-molten which is desirable for mold-release of the toner layer. Consequently, adhesive force is not produced between toner particles, and a phenomenon similar to "cold offset" (C.O.) occurs where toner particles adhere also to the photoconductor 1, so the transfer efficiency falls.

On the other hand, when the pressure is high, the transfer efficiency is good, but curl arises during transfer and jams often occur.

If the transfer temperature is too low, cold offset occurs, and if it is too high, hot offset occurs, so the transfer efficiency decreases.

Next, as shown in FIG. 1, a zinc stearate block 63 was provided in the cleaning apparatus 6 to improve the coefficient of friction of the photoconductor 1, zinc stearate was coated on the surface of the photoconductor 1 via a brush 62, the coefficient of friction of the photoconductor was reduced from 0.7 to 0.3, and transfer properties were verified.

In this case, from the results of Table 9, the applied pressure was 50N/cm$^2$, and the applied temperature was 50–150° C.

As shown in Table 10, these results show that the transfer efficiency was improved by coating zinc stearate.

TABLE 10

| Temperature | Pressure 5 [N/cm$^2$] |
|---|---|
| 50 [° C.] | Fair |
| 70 [° C.] | Good |
| 120 [° C.] | Good |
| 150 [° C.] | Good |

EXAMPLE III-3

The test apparatus was a digital copier MF7070 from Ricoh Company, Ltd. in FIG. 1 with a modified transfer unit using the developer G. Using a photoconductor 1 having a photoconductor roughness Rz of 3.1 μm and a transfer paper having a paper roughness Rz of 15 μm, the image was developed with the two-component magnetic brush developing apparatus, and transferred by the concurrent use of heat and pressure. The transfer pressure was 50N/cm$^2$ in terms of contact pressure, and the temperature of the transfer belt 53 was set to 120° C. In the following fixing step by the fixing apparatus 7, fixing was performed by applying pressure to the toner with a contact pressure of 50N/cm$^2$, the fixing nip width being approximately 10 mm, and the temperature was set to 175° C.

In this image-forming apparatus, by detaching the transfer apparatus 5 and cleaning apparatus 6 from the photoconductor 1 except during image-forming, or by leaving them permanently in contact, there are no problems in either case in an ordinary environment. In this regard, a tolerance test was performed in an environment wherein room temperature was 30° C. and the relative humidity was maintained at 60% RH.

Image-forming conditions were compared by printing 500 sheets (a chart with 6% character coverage of surface area) at 15 minute intervals over 8 hours (16,000 sheets), and running the equipment for 10 days.

As a result, in the image-forming apparatus operated where the transfer apparatus and cleaning apparatus were permanently in contact, toner adhered to the tip of a blade 61 of the cleaning apparatus 6, cleaning was poor, soiling of the photoconductor 1 and background shading of the image occurred, and black lines appeared after about 30,000 sheets.

On the other hand, in the image-forming apparatus operated with the transfer apparatus 5 and cleaning apparatus 6 separated from the photoconductor 1 except during image-forming, there were no problems even in the same test, and normal images were obtained.

EXAMPLE III-4

The test apparatus was a the digital copier MF7070 from Ricoh Company, Ltd. in FIG. 1 with a modified transfer unit. Using a photoconductor 1 having a photoconductor roughness Rz of 3.1 μm and a transfer paper having a paper roughness Rz of 15 μm, the image was developed with the two-component magnetic brush developing apparatus 4, and heat and pressure were applied by the transfer apparatus 5 to transfer the toner image. The transfer pressure was 50N/cm$^2$, and the belt temperature was set to 120° C.

In the following fixing step by the fixing apparatus 7, fixing was performed by applying pressure to the toner with a contact pressure of 9.3N/cm$^2$, the fixing nip width being approximately 10 mm, and the temperature was set to 175° C. Using this apparatus, a test chart based on a gray scale comprising binary dots at 600 dpi was printed out to obtain an image.

In this example, the aforesaid developers A, B, E and G were used as the developer.

An evaluation was made of transfer properties (transfer efficiency %) and fixing properties. Table 11 shows the results.

TABLE 11

| | Glass transition temperature (Tg) [° C.] | Softening temperature (Tm) [° C.] | Transfer efficiency | Fixing efficiency |
|---|---|---|---|---|
| Developer A | 53 | 98 | Bad | Good |
| Developer B | 71 | 165 | Fair | Bad |
| Developer E | 65 | 150 | Good | Good |
| Developer G | 65 | 153 | Good | Good |

From the above results, good results were obtained when the glass transition temperature Tg of the toner was 55–70° C. and the softening temperature Tm of the toner was 100–160° C. If Tg was less than 55° C., mold-release properties during transfer were poor, and toner storage properties were also poor.

On the other hand, if Tg was higher than 70° C., there was no adhesive force between toner particles during transfer, toner particles remained on the photoconductor and fixing properties during fixing were also poor. If Tm was less than 100° C., mold-release properties during transfer were poor, and storage properties were also poor. If Tm was higher than 160° C., heat fixing properties during fixing were poor.

However, if the glass transition temperature Tg of the toner was in the range of 50–80° C. and the toner softening temperature Tm was in the range of 100–180° C., there were no problems in practice.

EXAMPLE III-5

The test apparatus was a digital copier MF7070 from Ricoh Company, Ltd. in FIG. 1 with a modified transfer unit. Using a photoconductor 1 having a photoconductor roughness Rz of 3.1 μm and a transfer paper having a paper roughness Rz of 15 μm, the image was developed with the two-component magnetic brush developing apparatus 4, and heat and pressure were applied by the transfer apparatus 5 to transfer the toner image. The transfer pressure was 50N/cm$^2$, and the belt temperature was set to 120° C. In the fixing step by the fixing apparatus 7, fixing was performed by applying pressure to the toner with a contact pressure of 9.3N/cm$^2$, the fixing nip width being approximately 10 mm, and the temperature was set to 175° C. Using this apparatus, a test chart based on gray scale comprising binary dots at 600 dpi was printed out to obtain an image.

In this example, the aforesaid developers C, D, E and G were used as the developer.

An evaluation was made of transfer properties (transfer efficiency %) and fixing properties. Table 12 shows the results.

TABLE 12

| | Glass transition temperature (Tg) [° C.] | Softening temperature (Tm) [° C.] | Melt viscosity temperature [° C.] | Transfer efficiency | Fixing efficiency |
|---|---|---|---|---|---|
| Developer C | 56 | 105 | 118 | Bad | Fair (H.O) |
| Developer D | 71 | 165 | 172 | Bad | Bad |
| Developer E | 65 | 150 | 125 | Good | Good |
| Developer G | 65 | 153 | 152 | Good | Good |

Developer C satisfies the preferred temperature range for Tg and Tm of the toner observed in Example III-3, but as the temperature for a melt viscosity of 1000 PaS was too low, hot offset (H.O.) appeared during fixing.

Developer D satisfies the preferred temperature range for Tg and Tm of the toner observed in Example III-3, but as the temperature for a melt viscosity of 1000 PaS was too high, fixing could not be performed.

From the above results, good results were obtained when the temperature for a melt viscosity of 1000 PaS was in the range of 120–170° C. If it was less than 120° C., hot offset tended to occur during fixing. If it was higher than 170° C., hot fixing properties during fixing were poor, and if is exceeded 190° C., they rapidly deteriorated.

EXAMPLE III-6

The tests for evaluating the toner conditions which satisfy transfer and fixing requirements were completed in Examples III-4, 5, so in this example, image quality was evaluated.

The test apparatus was a digital copier MF7070 from Ricoh Company, Ltd. in FIG. 1 with a modified transfer unit. Using a photoconductor 1 having a photoconductor roughness Rz of 3.1 μm and a transfer paper having a paper roughness Rz of 15 μm, the image was developed with the two-component magnetic brush developing apparatus 4, and heat and pressure were applied by the transfer apparatus 5 to transfer the toner image. The transfer pressure was 50 $N/cm^2$, and the belt temperature was set to 120° C.

In the fixing step by the fixing apparatus 7, fixing was performed by applying pressure to the toner with a contact pressure of $9.3N/cm^2$, the fixing nip width being approximately 10 mm, and the temperature was set to 175° C. Using this apparatus, a test chart based on gray scale comprising binary dots at 600 dpi was printed out to obtain an image.

In this example, the aforesaid developers E, F, G, H, I and J were used. The toner in all of these developers satisfied the transfer and fixing requirements of Examples III-4, 5, and there was no problem regarding transfer efficiency and fixing properties.

The image quality was evaluated using the half-tone granularity. Table 13 shows the results.

TABLE 13

| | Sphericity | Dis-persion | Volume-specific resistivity [Ω · cm] | Apparent density [g/ml] | Granularity |
|---|---|---|---|---|---|
| Developer E | 0.9 | 1.46 | $5.50 \times 10^8$ | 0.29 | Very Bad |
| Developer F | 0.9 | 1.46 | $7.50 \times 10^8$ | 0.29 | Very Bad |
| Developer G | 0.95 | 1.41 | $8.50 \times 10^8$ | 0.29 | Bad |
| Developer H | 0.96 | 1.35 | $9.50 \times 10^8$ | 0.29 | Fair |
| Developer I | 0.97 | 1.35 | $2.50 \times 10^9$ | 0.29 | Good |
| Developer J | 0.97 | 1.35 | $2.50 \times 10^9$ | 0.35 | Very Good |

There is a significant difference between the developers E, F and the developer G in granularity, and in terms of the physical properties of the toner, a significant difference was found in the toner sphericity.

If the toner sphericity is above or below 0.95, there is a difference in granularity, so the toner sphericity was preferably 0.95 or more. If the average sphericity was less than 0.95, the toner particles had an irregular shape, the cohesion of the toner image on the photoconductor 1 was non-uniform, the way in which heat and pressure were applied during transfer was non-uniform, and transfer efficiency and transfer quality were poor.

Next, there is a significant difference between the developer G and the developer H in granularity, and in terms of the physical properties of the toner, a significant difference was found in the toner dispersion.

If the dispersion is above or below 1.4, there is a difference in granularity, so the dispersion is preferably 1.4 or less. If the dispersion is larger than 1.4, it is more difficult to apply pressure and heat uniformly in the transfer step, so transfer unevenness occurs which was undesirable.

There is a significant difference between the developer H and the developer I in granularity, and in terms of the physical properties of the toner, a significant difference was found in the volume resistivity.

If the volume resistivity is above or below $1\times10^9$ (Ω·cm), there is a significant difference in granularity, so the volume resistivity is preferably $1\times10^9$ (Ω·cm) or more.

If it is less than 1×10 (Ω·cm), the toner image is thinly developed, the pressure during transfer is non-uniform, and unevenness appears in transfer.

There is a significant difference between the developer I and the developer J in granularity, and in terms of the physical properties of the toner, a significant difference was found in the apparent density.

The apparent density is affected by granularity, so the apparent density was preferably 0.3 g/ml or more. If it was less than 0.30 g/ml, toner cohesion became stronger, the toner image thickness on the photoconductor 1 was non-uniform and pressure application in the transfer step was non-uniform, so transfer efficiency and transfer quality deteriorated. Also, condensed toner fell into the non-image part, so the image was unpleasantly soiled.

As described above, according to the image-forming apparatus and image-forming method using the apparatus of the present invention, by half fixing the toner image to the transfer paper simultaneously with transfer in the transfer step where there is a large image deterioration, image deterioration such as dust or blurring due to the effect of electrostatic discharge can be prevented, and a good quality image can be formed.

Further, by specifying the physical properties of the toner in the developer used in the developing apparatus of the image-forming apparatus according to the present invention, a good quality image with satisfactory transfer properties and fixing properties can be obtained.

EXAMPLE IV

Next, examples of an image-forming apparatus and an image-forming method according to the present invention wherein a pressure of $10–100N/cm^2$ is applied between the transfer roller and photoconductor, will be described.

<Test Method>

The toner evaluation method will be described. The test apparatus was a Ricoh Imagio MF7070 with a modified transfer unit. The construction is identical to the schematic diagram of the apparatus in FIG. 1. Developing was performed by a one-component non-contact method. The transfer and primary fixing pressure was $60N/cm^2$ in terms of contact pressure, and the belt temperature was set to 100° C. In a secondary fixing step, fixing was performed by applying pressure to the toner with a contact pressure of $9.3N/cm^2$, the fixing nip width being approximately 10 mm, and the temperature was set to 175° C. Using this apparatus, a test chart based on a gray scale comprising binary dots at 600 dpi was printed out to obtain an image.

Regarding image quality, there was toner dust and blurring in the toner image transfer step, the volume and surface area changed after fixing, and image quality was poor. This phenomenon was particularly marked in the case of digital developing, and the reproducibility of individual dots was largely affected.

The half-tone density should be uniform, but if there is a microscopic density unevenness, the image will have a grainy appearance when viewed with the naked eye. The quality of the image is represented by the granularity which is a physical parameter of graininess.

In addition to granularity, other test items were the transfer properties (primary fixing properties) and fixing properties.

Transfer properties were evaluated by calculating the efficiency of displacing a 2×2 cm adhesion amount of a black solid fills part on the photoconductor to a transfer paper by heat and pressure without using static charge. A transfer efficiency of 80% or more was determined as "Good", 60–79% was indicated by "Fair" and 59% or less was shown by "Bad". The tolerance level was "Fair" or more.

Next, fixing properties were evaluated by the smear method (a cloth adhering under a weight of 8.8N/15 ϕwas placed on the transfer paper, and the density on the cloth was measured after scratching 5 times back and forth). The level of 0.3 or less at which there was no problem was indicated by "Good", the tolerance level of 0.5 or less was indicated by "Fair", and the level of 0.51 or more was indicated by "Bad".

Further, for granularity which is representative of high image quality, a value of 0.29 or less was indicated by "Good", and 0.3–0.39 was indicated by "Fair" which was the tolerance level. 0.4 or higher was indicated by "Bad".

The method of manufacturing the toner used in the following tests, and the carrier used, will now be described.

Toner A

| (Toner ingredients) | |
|---|---|
| Polyester resin (weight average molecular weight: 52000, Tg: 54° C.) | 82 parts by weight |
| Polypropylene wax (molecular weight 900) | 5 parts by weight |
| Carbon black (Mitsubishi Chemical Corporation, No. 44) | 12 parts by weight |
| Charge controlling agent (Spiron Black TR-H: Hodogaya Chemical Co., Ltd.) | 1 part by weight |

The above ingredients were kneaded at 80° C. using a two-axis extruder, crushed in an air current mill, graded to a weight average particle diameter of 0.5 μm (weight average particle diameter/number average particle diameter= 1.45), and mixed with 0.25% by weight of silica (R-972, Japan Aerogel) using a Henschel mixer to obtain a toner.

The softening temperature of this toner was 98° C., the volume resistivity was 97.5×108 Ω·cm, the average sphericity was 0.91, Tg was 53° C., the temperature at which the melt viscosity was 1000 Pas was 115° C., and the apparent density was 0.28 g/cc.

Toner B

| (Toner ingredients) | |
|---|---|
| Polyester resin (weight average molecular weight: 182500, Tg: 71° C.) | 82 parts by weight |
| Polyethylene wax (molecular weight 1200) (weight average molecular weight: 105000, Tg: 58° C.) | 5 parts by weight |
| Carbon black (Mitsubishi Chemical Corporation, No. 44) | 12 parts by weight |

-continued

Toner B

| (Toner ingredients) | |
|---|---|
| Charge controlling agent (Spiron Black TR-H: Hodogaya Chemical Co., Ltd.) | 1 parts by weight |

The above ingredients were kneaded at 160° C. using a two-axis extruder, crushed in an air current mill, graded to a weight average particle diameter of 9.5 μm (weight average particle diameter/number average particle diameter= 1.42), and mixed with 0.25% by weight of silica (R-972, Japan Aerogel) using a Henschel mixer to obtain a toner.

The softening temperature of this toner was 165° C., the volume resistivity was $8.5\times10^8$ Ω·cm, the average sphericity was 0.91, Tg was 71° C., the temperature at which the melt viscosity was 1000 Pas was 175° C., and the apparent density was 0.29 g/ml.

Toner C

| (Toner ingredients) | |
|---|---|
| Polyester resin (weight average molecular weight: 182500, Tg: 71° C.) | 45 parts by weight |
| Styrene-butyl acrylate copolymer (weight average molecular weight: 105000, Tg: 58° C.) | 40 parts by weight |
| Polypropylene wax (VISCOL 550P: Sanyo Chemical Industries, Ltd.) | 4 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 100° C. using a two-axis extruder, crushed in an air current mill, graded to a weight average particle diameter of 8.5 μm (weight average particle diameter/number average particle diameter= 1.45), and mixed with 0.50% by weight of silica (R-972, Japan Aerogel) using a Henschel mixer to obtain a toner.

The softening temperature of this toner was 105° C., the volume resistivity was $9.5\times10^8$ Ω·cm, the average sphericity was 0.91, Tg was 56° C., the temperature at which the melt viscosity was 1000 Pas was 118° C., and the apparent density was 0.29 g/cc.

Toner D

| (Toner ingredients) | |
|---|---|
| Polyester resin (weight average molecular weight: 182500, Tg: 71° C.) | 65 parts by weight |
| Styrene-butyl acrylate copolymer (weight average molecular weight: 105000, Tg: 58° C.) | 20 parts by weight |
| Polypropylene wax (VISCOL 550P: Sanyo Chemical Industries, Ltd.) | 4 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 150° C. using a two-axis extruder, crushed in an air current mill, graded to a weight average particle diameter of 8.5 μm (weight average particle diameter/number average particle diameter=1.43), and mixed with 0.50% by weight of silica (R-972, Japan Aerogel) using a Henschel mixer to obtain a toner.

The softening temperature of this toner was 155° C., the volume resistivity was $7.5\times10^8$ Ω·cm, the average sphericity was 0.90, Tg was 68° C., the temperature at which the melt viscosity was 1000 Pas was 172° C., and the apparent density was 0.29 g/cc.

Toner E

| (Toner ingredients) | |
|---|---|
| Polyester resin (weight average molecular weight: 182500, Tg: 71° C.) | 35 parts by weight |
| Styrene-butyl acrylate copolymer (weight average molecular weight: 105000, Tg: 58° C.) | 49 parts by weight |
| Polypropylene wax (VISCOL 550P: Sanyo Chemical Industries, Ltd.) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 120° C. using a two-axis extruder, crushed in an air current mill, graded to a weight average particle diameter of 7.0 μm (weight average particle diameter/number average particle diameter=1.46), and mixed with 0.75% by weight of silica (R-972, Japan Aerogel) using a Henschel mixer to obtain a toner.

The softening temperature of this toner was 150° C., the volume resistivity was $5.5\times10^8$ Ω·cm, the average sphericity was 0.90, Tg was 65° C., the temperature at which the melt viscosity was 1000 Pas was 125° C., and the apparent density was 0.29 g/cc.

Toner F

| (Toner ingredients) | |
|---|---|
| Polyester resin (weight average molecular weight: 182500, Tg: 71° C.) | 60 parts by weight |
| Styrene-butyl acrylate copolymer (weight average molecular weight: 105000, Tg: 58° C.) | 24 parts by weight |
| Polypropylene wax (VISCOL 550P: Sanyo Chemical Industries, Ltd.) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 140° C. using a two-axis extruder, crushed in an air current mill, graded to a weight average particle diameter of 7.0 μm (weight average particle diameter/number average particle diameter=1.46), and mixed with 0.75% by weight of silica (R-972, Japan Aero gel) using a Henschel mixer to obtain a toner.

The softening temperature of this toner was 150° C., the volume resistivity was $7.5\times10^8$ Ω·cm, the average sphericity was 0.90, Tg was 65° C., the temperature at which the melt viscosity was 1000 Pas was 165° C., and the apparent density was 0.29 g/cc.

Toner G

| (Toner ingredients) | |
|---|---|
| Polyester resin (weight average molecular weight: 182500, Tg: 71° C.) | 58 parts by weight |
| Styrene-butyl acrylate copolymer (weight average molecular weight: 105000, Tg: 58° C.) | 26 parts by weight |
| Polypropylene wax (VISCOL 550P: Sanyo Chemical Industries, Ltd.) | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 140° C. using a two-axis extruder, crushed in a mechanical crusher, graded to a weight average particle diameter of 7.5 μm (weight average particle diameter/number average particle diameter=1.41), and mixed with 0.75% by weight of silica (R-972, Japan Aerogel) using a Henschel mixer to obtain a toner.

The softening temperature of this toner was 153° C., the volume resistivity was $8.5\times10^8$ Ω·cm, the average sphericity was 0.95, Tg was 65° C., the temperature at which the melt viscosity was 1000 Pas was 152° C., and the apparent density was 0.29 g/cc.

Toner H

| (Toner ingredients) | |
|---|---|
| Polyester resin (weight average molecular weight: 182500, Tg: 71° C.) | 60 parts by weight |
| Styrene-butyl acrylate copolymer (weight average molecular weight: 105000, Tg: 58° C.) | 24 parts by weight |
| Carnauba wax | 5 parts by weight |
| Carbon black (Mitsubishi Chemical Corporation, No. 44) | 10 parts by weight |
| Charge controlling agent (Spiron Black TR-H: Hodogaya Chemical Co., Ltd.) | 1 part by weight |

The above ingredients were kneaded at 135° C. using a two-axis extruder, crushed in a mechanical crusher, graded to a weight average particle diameter of 6.5 μm (weight average particle diameter/number average particle diameter=1.35), and mixed with 1.00% by weight of silica (R-972, Japan Aerogel) using a Henschel mixer to obtain a toner.

The softening temperature of this toner was 150° C., the volume resistivity was $9.5\times10^8$ Ω·cm, the average sphericity was 0.98, Tg was 65° C., the temperature at which the melt viscosity was 1000 Pas was 145° C., and the apparent density was 0.29 g/cc.

Toner I

| (Toner ingredients) | |
|---|---|
| Polyester resin (weight average molecular weight: 182500, Tg: 71° C.) | 60 parts by weight |
| Styrene-butyl acrylate copolymer (weight average molecular weight: 105000, Tg: 58° C.) | 27 parts by weight |

-continued

| Toner I | |
|---|---|
| (Toner ingredients) | |
| Carnauba wax | 5 parts by weight |
| Carbon black (Mitsubishi Chemical Corporation, No. 44) | 7 parts by weight |
| Charge controlling agent (Spiron Black TR-H: Hodogaya Chemical Co., Ltd.) | 1 part by weight |

The above ingredients were kneaded at 130° C. using a two-axis extruder, crushed in a mechanical crusher, graded to a weight average particle diameter of 6.5 μm (weight average particle diameter/number average particle diameter=1.35), and mixed with 1.00% by weight of silica (R-972, Japan Aerogel) using a Henschel mixer to obtain a toner.

The softening temperature of this toner was 150° C., the volume resistivity was $2.5\times10^9$ Ω·cm, the average sphericity was 0.97, Tg was 62° C., the temperature at which the melt viscosity was 1000 Pas was 145° C., and the apparent density was 0.29 g/cc.

| Toner J | |
|---|---|
| (Toner ingredients) | |
| Polyester resin (weight average molecular weight: 182500, Tg: 71° C.) | 60 parts by weight |
| Styrene-butyl acrylate copolymer (weight average molecular weight: 105000, Tg: 58° C.) | 27 parts by weight |
| Carnauba wax | 5 parts by weight |
| Carbon black (Mitsubishi Chemical Corporation, No. 44) | 7 parts by weight |
| Charge controlling agent (Spiron Black TR-H: Hodogaya Chemical Co., Ltd.) | 1 part by weight |

The above ingredients were kneaded at 130° C. using a two-axis extruder, crushed in a mechanical crusher, graded to a weight average particle diameter of 6.5 μm (weight average particle diameter/number average particle diameter=1.35), and mixed with 1.50% by weight of silica (R-972, Japan Aerogel) using a Henschel mixer to obtain a toner.

The softening temperature of this toner was 150° C., the volume resistivity was $2.5\times10^9$ Ω·cm, the average sphericity was 0.97, Tg was 62° C., the temperature at which the melt viscosity was 1000 Pas was 145° C., and the apparent density was 0.35 g/cc.

EXAMPLE IV-1

Using the toner H (Tg=65° C., Tm=150° C.), the test apparatus was a Ricoh Imagio MF7070 in FIG. 1 with a modified transfer unit. Developing was performed by the one-component non-contact method. The transfer and primary fixing pressure was 60N/cm$^2$ in terms of contact pressure, and the belt temperature was set to 100° C. (Tg<100° C.<Tm). In a secondary fixing step, fixing was performed by applying pressure to the toner with a contact pressure of 9.3N/cm$^2$, the fixing nip width being approximately 10 mm, and the temperature was set to 175° C. Using this apparatus, a test chart based on a gray scale comprising binary dots at 600 dpi was printed out to obtain an image.

An optimization test for simultaneous transfer and temporary fixing was performed under the following conditions.

The toner particle diameter (weight average) was 6.5 μm (which is represented by "a"). Three photoconductors having different surface roughness Rz, 2.5 μm, 3.1 μm and 4.8 μm, were prepared. Using amorphous silicone photoconductors for the photoconductor 1, each surface was buffed with a metal oxide powder to obtain a desired roughness. Three types of transfer paper having different surface roughnesses (paper roughnesses) Rz, 8 μm, 15 μm and 24 μm, were also prepared. Each transfer paper having the desired surface roughness was selected from coated and plain papers. The surface roughness was measured by the line roughness measurement mode using a VK8500 from KEYENCE CORPORATION. Table 8 shows the result for transfer efficiency. Table 14 shows the results.

TABLE 14

| | Paper roughness | | |
|---|---|---|---|
| Photoconductor Roughness | 8 μm (<2a) | 15 μm (>2a) | 24 μm (>2a) |
| 2.5 μm(<a/2) | Bad | Good | Good |
| 3.1 μm(≈a/2) | Bad | Good | Good |
| 4.8 μm(>a/2) | Bad | Bad | Good |

*) The test was performed on transfer primary fixing properties
Good: transfer efficiency of 80% or more
Fair: 60–70%
Bad: 59% or less From the above, good results were obtained when the paper roughness was 15 μm, 2.3 times as much as the toner diameter, or more, and photoconductor roughness was 3.1 μm, 0.48 times as much, or less. From the above, good results were obtained when the photoconductor roughness was ½ or less than the toner particle diameter, and the transfer paper roughness was 2 or more times the toner particle diameter.

EXAMPLE IV-2

Using the toner H (Tg=65° C., Tm=150° C.), the test apparatus was a Ricoh Imagio MF7070 in FIG. 1 with a modified transfer unit. Developing was performed by the one-component non-contact method. The transfer and primary fixing pressure, and belt temperature were applied to perform transfer and primary fixing. In a secondary fixing step, fixing was performed by applying pressure to the toner with a contact pressure of 9.3N/cm$^2$, the fixing nip width being approximately 10 mm, and the temperature was set to 175° C. Using this apparatus, a test chart based on a gray scale comprising binary dots at 600 dpi was printed out to obtain an image. The pressure between the photoconductor and transfer paper and the belt temperature used in transfer and primary fixing were verified when the roughness of the photoconductor was ½ the toner particle diameter or less, and the roughness of the transfer paper was 2 times the toner particle diameter or more.

The test was performed with the same transfer efficiency as that of the examples. Table 15 shows the results.

TABLE 15

| | Pressure | | | | |
|---|---|---|---|---|---|
| Temperature | 2 N/cm$^2$ | 10 N/cm$^2$ | 60 N/cm$^2$ | 100 N/cm$^2$ | 150 N/cm$^2$ |
| 45° C. | Bad | Bad | Bad/Fair | Good | Good |
| 65° C. | Fair-Bad | Good | Good/Good | Good | Fair |

TABLE 15-continued

| | Pressure | | | | |
|---|---|---|---|---|---|
| Temperature | 2 N/cm$^2$ | 10 N/cm$^2$ | 60 N/cm$^2$ | 100 N/cm$^2$ | 150 N/cm$^2$ |
| 150° C. | Fair-Bad | Good | Good/Good | Good | Bad |
| 170° C. | Bad | Fair | Fair/Good | Bad | Bad |

Due to the above, good results were obtained when the pressure was 10–100N/cm$^2$, and the applied temperature was within a range from the glass transition temperature of the toner to the toner softening temperature.

The transfer properties were also examined after varying the coefficient of friction from 0.7 to 0.3 at a pressure of 60N/cm$^2$. Regarding coefficient of friction of the photoconductor, a zinc stearate block to improve the coefficient of friction of the photoconductor was provided in the cleaning part of FIG. 1, and coated on the photoconductor via a brush to obtain two conditions. Results are shown in Table 15 at the same column of 60N/cm$^2$ for temperatures from 45° C. to 170° C. on the right side of the slashes.

From the above results, the transfer efficiency is improved by coating zinc stearate.

EXAMPLE IV-3

Using the toner H (Tg=65° C., Tm=150° C.), the test apparatus was a Ricoh Imagio MF7070 in FIG. 1 with a modified transfer unit. Developing was performed by the one-component non-contact method. The transfer and primary fixing pressure was 60N/cm$^2$ in terms of contact pressure, and the belt temperature was set to 100° C. (Tg<100° C.<Tm). In a secondary fixing step, fixing was performed by applying pressure to the toner with a contact pressure of 9.3N/cm$^2$, the fixing nip width being approximately 10 mm, and the temperature was set to 175° C. Using this apparatus, the aging of properties were verified when the transfer unit and cleaning unit were detached except during image-forming, and when they were permanently in contact during operation.

In the normal environment, there was no problem. A tolerance test was performed in an environment where the temperature was 30° C. at 60% relative humidity.

The image-forming conditions were compared by printing 500 sheets (a chart with 6% character coverage of surface area) at 15 minute intervals over 8 hours (16,000 sheets) for 10 days.

As a result, in a machine where the two units were permanently in contact during operation, toner adhered to the cleaning blade tip, cleaning was poor, photoconductor soiling and image background shading occurred, and faint black lines appeared after about 50,000 sheets.

On the other hand, when the transfer unit and cleaning unit were detached except during image-forming, there was no problem in the same test, and normal images were obtained.

EXAMPLE IV-4

The test apparatus was a Ricoh Imagio MF7070 in FIG. 1 with a modified transfer unit. For developing, a one-component non-contact type developing apparatus was used. The transfer and primary fixing pressure was 60N/cm$^2$ in terms of contact pressure, and the belt temperature was set to 100° C. (Tg<100° C.<Tm). In a secondary fixing step, fixing was performed by applying pressure to the toner with a contact pressure of 9.3N/cm$^2$, the fixing nip width being approximately 10 mm, and the temperature was set to 175° C. To improve release of the toner from the photoconductor in the simultaneous transfer and primary fixing, and make the toner adhere more easily to the transfer paper, the photoconductor roughness was adjusted to a/2 and the transfer paper surface roughness was adjusted to 3a, where the toner particle diameter was a, and a test chart based on a gray scale formed of binary dots at 600 dpi was printed out to obtain an image.

The toners used in this example were the aforesaid A, B, C, and H.

The evaluation was performed on transfer and primary fixing properties (transfer efficiency %), secondary transfer (smear density) and granularity. Table 16 shows the results.

TABLE 16

| | | | Test results | | |
|---|---|---|---|---|---|
| Toner | Softening temperature Tm(° C.) | Glass transition temperature Tg(° C.) | Transfer and primary fixing | Secondary fixing | Granularity |
| A | 98 | 53 | Bad | Bad | Bad |
| C | 105 | 56 | Good | Fair | Good |
| H | 150 | 65 | Good | Good | Good |
| B | 165 | 71 | Bad | Bad | Bad |

From the above, good results were obtained when the toner softening temperature was 100–160° C., and the glass transition temperature was 55–70° C.

EXAMPLE IV-5

The test was performed by an identical method to that of Example IV-4. The toners used in this example were the aforesaid toners D, E, H, I.

The evaluation was performed on transfer and primary fixing properties (transfer efficiency %), secondary fixing (smear density) and granularity. Table 17 shows the results. Herein, dispersion is weight average particle diameter divided by number average particle diameter.

TABLE 17

| | | | Test results | | |
|---|---|---|---|---|---|
| Toner | Sphericity | Dispersion | Transfer and primary fixing | Secondary fixing | Granularity |
| E | 0.90 | 1.46 | Bad | Fair | Fair |
| D | 0.90 | 1.43 | Bad | Fair | Good |
| I | 0.97 | 1.35 | Good | Fair | Good |
| H | 0.98 | 1.35 | Good | Good | Good |

From the above, good results were obtained for a sphericity of 0.92 or more, and a dispersion of 1.4 or less.

EXAMPLE IV-6

The test was performed by an identical method to that of Example IV-4. The toners used in this example employed the aforesaid toner ingredients. The physical properties used were the temperature at which the toner melt viscosity was 1000 PaS (i.e., the temperature at which the toner particles melted and adhered to each other), and other properties.

The evaluation was performed on transfer and primary fixing properties (transfer efficiency %), secondary fixing (smear density) and granularity. Table 18 shows the results.

TABLE 18

| Toner | Melt viscosity (° C.) | Test results: Transfer and primary fixing | Secondary fixing | Granularity |
|---|---|---|---|---|
| A | 115 | Bad | Bad | Bad |
| C | 118 | Bad | Fair | Fair |
| H | 145 | Good | Good | Good |
| F | 165 | Good | Good | Good |
| D | 172 | Bad | Fair | Fair |
| B | 175 | Bad | Bad | Fair |

From the above, the optimum range is 120–170° C.

EXAMPLE IV-7

The test was performed by an identical method to that of Example IV-4. The toners used in this example were the aforesaid toners H and J. The physical property used was the apparent density (g/cc).

The evaluation was performed on transfer and primary fixing properties (transfer efficiency %), secondary fixing (smear density) and granularity. Table 19 shows the results.

TABLE 19

| Toner | Apparent density (g/cc) | Test results: Transfer and primary fixing | Secondary fixing | Granularity |
|---|---|---|---|---|
| H | 0.29 | Good | Good | Good |
| J | 0.35 | Good | Good | Very Good |

From the above, the toner apparent density is preferably 0.3 g/cc or more. Herein, "Very Good" which was not used in the prior evaluations, was indicated. In this test, the best value of 0.21 was obtained.

EXAMPLE IV-8

The test was performed by an identical method to that of Example IV-4. The toners used in this example employed the aforesaid toner ingredients. The physical property used was the volume resistivity.

The evaluation was performed on transfer and primary fixing properties (transfer efficiency %), secondary fixing (smear density) and granularity. Table 20 shows the results.

TABLE 20

| Toner | Volume-specific resistivity (Ω· cm) | Test results: Transfer and primary fixing | Secondary fixing | Granularity |
|---|---|---|---|---|
| D | $7.5 \times 10^8$ | Bad | Fair | Fair |
| G | $8.5 \times 10^8$ | Bad | Fair | Good |
| I | $2.5 \times 10^9$ | Good | Fair | Good |
| J | $2.5 \times 10^9$ | Good | Good | Good |

From the above, good results were obtained when the volume resistivity was $1\times10^9$ Ω·cm or more.

From the above description, it is seen that in the image-forming method and image-forming apparatus of the present invention, toner particles deform so that the toner particle surfaces adhere lightly together, and the toner particles fill the depressions in the transfer paper, and then by an anchor effect the toner is transferred in the transfer and primary fixing step, and therefore image deterioration during transfer can be prevented whereas in the electrostatic method, an image is often deteriorated at the transfer step.

In the image-forming method and image-forming apparatus of the present invention, the transfer and primary fixing unit, which is the heat source, is detached except during image-forming, so temperature rise of the photoconductor can be prevented, image and system problems regarding heat are alleviated, and there is more design margin.

In the image-forming method and image-forming apparatus of the present invention, the photoconductor surface is made hard with a lower coefficient of friction, which improves toner mold-release properties and improves transfer efficiency.

In the image-forming method and image-forming apparatus of the present invention, by improving transfer efficiency, a high-quality image without any graininess can be obtained.

In the image-forming method and image-forming apparatus of the present invention, hot offset can be reduced.

What is claimed is:

1. An image-forming apparatus, comprising:

a latent image carrier having a surface on which a latent image is formed;

an image-developer which renders the latent image visible as a toner image by toner adhesion;

a transfer which transfers the toner image formed on the latent image carrier to a transfer material by heat and pressure;

a fixer which fixes the toner image transferred on the transfer material, to the transfer material; and a temperature controller which controls a heating temperature of the transfer within a range of from the glass transition temperature (Tg) of a toner being used to the softening temperature (Tm) of the toner, and lower than a fixing temperature of the fixer.

2. The image-forming apparatus according to claim 1, wherein the latent image carrier comprises a member selected from the group consisting of an amorphous silicone an organic photoconductor and mixtures thereof.

3. The image-forming apparatus according to claim 1, wherein the image-developer comprises a toner container having a toner therein.

4. The image-forming apparatus according to claim 3, wherein the toner comprises:

a softening temperature (Tm) of from 90° C. to 170° C., a glass transition temperature (Tg) of from 50° C. to 70° C., and a weight average particle diameter of from 3.0 μm to 10 μm.

5. The image-forming apparatus according to claim 4, wherein the latent image carrier comprises amorphous silicone, and the toner has a softening temperature (Tm) of from 100° C. to 170° C., and a glass transition temperature (Tg) of from 55° C. to 70° C.

6. The image-forming apparatus according to claim 5, wherein the heating temperature of the transfer is controlled within a range of from a 70° C. to 120° C., and the fixing temperature is controlled within a range of from 160° C. to 200° C.

7. The image-forming apparatus according to claim 4, wherein the latent image carrier comprises an organic photoconductor, and the toner has a softening temperature (Tm) of from 90° C. to 110° C., and a glass transition temperature (Tg) of from 50° C. to 65° C.

8. The image-forming apparatus according to claim 7, wherein the heating temperature of the transfer is controlled within a range of from 50° C. to 80° C., and the fixing temperature is controlled within a range of from 160° C. to 200° C.

9. The image-forming apparatus according to claim 3, wherein the volume resistivity of the toner is $1\times10^9$ Ωcm or more.

10. The image-forming apparatus according to claim 3, wherein the volume resistivity of the toner is less than $1\times10^9$ Ωcm.

11. The image-forming apparatus according to claim 3, wherein the average sphericity of the toner is 0.90 or more.

12. The image-forming apparatus according to claim 3, wherein in the dispersion of toner particle diameters (weight average particle diameter/number average particle diameter) is 1.4 or less.

13. The image-forming apparatus according to claim 3, wherein a temperature at which the melt viscosity of the toner is 1000 PaS, is from 120° C. to 170° C.

14. The image-forming apparatus according to claim 3, wherein the toner has an apparent density of 0.30 g/ml or more.

15. The image-forming apparatus according to claim 1, wherein the temperature controller controls the heating temperature of the transfer within a range of from 70° C. to 100° C.

16. The image-forming apparatus according to claim 1, wherein the transfer comprises a heating roller, and a contact pressure between the heating roller and the latent image carrier is from $2N/cm^2$ to $100N/cm^2$.

17. The image-forming apparatus according to claim 16, wherein the contact pressure between the heating roller and the latent image carrier is from $2N/cm^2$ to $100N/cm^2$.

18. The image-forming apparatus according to claim 16, wherein the contact pressure between the heating roller and the latent image carrier is from $100N/cm^2$ to $100N/cm^2$.

19. The image-forming apparatus according to claim 1, further comprising:

a driver which attaches the transfer to and detaches the transfer from the latent image carrier, and a controller which controls the driver so as to attach the transfer to the latent image carrier synchronously with a transfer operation in which the toner image is transferred from the latent image carrier to the transfer material, and to detach the transfer from the latent image carrier when the transfer operation is not conducted.

20. The image-forming apparatus according to claim 19, further comprising a cleaner, wherein the image-developer and the cleaner can be attached to and detached from the photoconductor, wherein the image-developer and the cleaner are maintained at detached positions from the photoconductor except when an image is formed.

21. The image-forming apparatus according to claim 20, wherein the cleaner comprises:

a blade;

a rotatable brush; and a block of a metal salt of a fatty acid mounted in contact with rotatable brush, wherein the rotation of the brush applies the metal salt on the photoconductor.

22. The image-forming apparatus according to claim 21, wherein the metal salt of a fatty acid is a zinc stearate and an application of zinc stearate renders the coefficient of friction of a surface of the photoconductor to 0.6 or less.

23. The image-forming apparatus according to claim 1, satisfying the following formula:

$$Rz<(a/2)$$

wherein Rz represents a 10-point average roughness of a surface of the latent image carrier, and "a" represents a particle diameter of the toner.

24. A process for forming an image, comprising:

developing a latent image on a latent image carrier so as to render the latent image visible as a toner image by toner adhesion;

transferring the toner image formed on the latent image carrier to a transfer material by heat and pressure; and fixing the toner image transferred to the transfer material, to the transfer material, wherein a heating temperature for transferring is controlled within a range of from the glass transition temperature (Tg) of a toner being used to the softening temperature (Tm) of the toner, and lower than a fixing temperature for fixing.

25. The process for forming an image according to claim 24, wherein a surface roughness of the transfer material is twice as much or more than twice as much as a diameter of a toner particle of an image-developer being used for developing.

26. The process for forming an image according to claim 24, wherein the toner comprises:

a softening temperature (Tm) of from 90° C. to 170° C., a glass transition temperature (Tg) of from 50° C. to 70° C., and a weight average particle diameter of from 3.0 μm to 10.0 μm.

27. The process for forming an image according to claim 24, wherein the average sphericity of the toner is 0.90 or more.

28. The process for forming an image according to claim 24, wherein in the dispersion of toner particle diameters (weight average particle diameter/number average particle diameter) is 1.4 or less.

29. The process for forming an image according to claim 24, wherein a temperature at which the melt viscosity of the toner is 1000 PaS, is from 120° C. to 170° C.

30. The process for forming an image according to claim 24, wherein the toner has an apparent density of 0.30 g/ml or more.

* * * * *